US010584005B2

(12) United States Patent
Harada et al.

(10) Patent No.: US 10,584,005 B2
(45) Date of Patent: Mar. 10, 2020

(54) MEDIUM FEED DEVICE AND IMAGE READING APPARATUS

(71) Applicant: SEIKO EPSON CORPORATION, Tokyo (JP)

(72) Inventors: Hidenori Harada, Kitakyushu (JP); Ryoichi Shuto, Kitakyushu (JP); Keiichiro Fukumasu, Kitakyushu (JP); Kazuhiko Tsuyama, Kitakyushu (JP); Tomoyuki Mokuo, Kitakyushu (JP); Tokujiro Okuno, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/846,074

(22) Filed: Dec. 18, 2017

(65) Prior Publication Data

US 2018/0194579 A1 Jul. 12, 2018

(30) Foreign Application Priority Data

Jan. 6, 2017 (JP) ..... 2017-000918

(51) Int. Cl.
*B65H 3/06* (2006.01)
*B65H 1/02* (2006.01)
*B65H 3/52* (2006.01)

(52) U.S. Cl.
CPC ..... *B65H 3/0653* (2013.01); *B65H 1/02* (2013.01); *B65H 1/027* (2013.01); *B65H 3/063* (2013.01); *B65H 3/0684* (2013.01); *B65H 3/523* (2013.01); *B65H 2402/46* (2013.01); *B65H 2405/2111* (2013.01); *B65H 2511/21* (2013.01); *B65H 2515/81* (2013.01)

(58) Field of Classification Search
CPC ..... B65H 3/523; B65H 3/0653; B65H 3/063; B65H 3/0684; B65H 2405/2111; B65H 1/06
USPC ..... 271/127, 131, 162, 118
See application file for complete search history.

(56) References Cited

U.S. PATENT DOCUMENTS 6,227,535 B1 * 5/2001 Bae ..... B65H 3/5215 271/121
6,547,237 B2 * 4/2003 Sugino ..... B65H 3/0661 271/119
6,575,453 B2 * 6/2003 Chiang ..... B65H 3/063 271/124
7,455,288 B2 * 11/2008 Ruhe ..... B65H 1/04 271/124
8,827,267 B2 * 9/2014 Hongo ..... B65H 3/063 271/258.01
9,415,954 B2 * 8/2016 Ukai ..... B65H 1/02
9,902,580 B2 * 2/2018 Okumura ..... B65H 1/06
(Continued)

FOREIGN PATENT DOCUMENTS

JP 2006-165857 6/2006
JP 2014-047050 3/2014

*Primary Examiner* — Patrick Cicchino
(74) *Attorney, Agent, or Firm* — Workman Nydegger

(57) ABSTRACT

A medium feed device includes a feed roller provided to a device body and configured to feed paper, a separator roller provided at a position on the device body facing the feed roller and configured to separate the paper, and a medium support section configured to support the medium in an inclined state upstream of the feed roller. The medium support section is configured with a variable contact angle between the paper supported by the medium support section and the separator roller.

6 Claims, 23 Drawing Sheets

(56) References Cited

U.S. PATENT DOCUMENTS

| | | | | |
|---|---|---|---|---|
| 2006/0012109 | A1* | 1/2006 | Chiang | B65H 1/12 271/121 |
| 2014/0061998 | A1 | 3/2014 | Kasashima et al. | |

* cited by examiner

MEDIUM FEED DEVICE AND IMAGE READING APPARATUS

BACKGROUND

1. Technical Field

The present invention relates to a medium feed device to feed a medium and to an image reading apparatus provided therewith.

2. Related Art

As an example of an image reading apparatus, there are scanners provided with a medium feed device, also referred to as an auto document feeder (ADF), to automatically feed paper as a medium, so as to enable plural sheets of paper to be automatically fed and read.

Such medium feed devices are sometimes configured such that plural sheets of the paper to be read are set in a stacked state supported by an inclined medium placement section (see, for example, JP-A-2014-47050).

There are various types of paper that are read in such image reading apparatuses, such as paper having comparatively low stiffness, referred to as normal paper; postcards having higher stiffness than normal paper; and the like.

When paper of low stiffness is placed on a medium placement section, if the angle of the placement face of the medium placement section is too steep, then sometimes what is referred to as a paper-slide occurs, which is when the paper slips down under its own weight. This may lead to a problem that the paper is not transportable in a normal manner.

Moreover, when paper of high stiffness is placed on the medium placement section, if the angle of the placement face is too gentle, then there is a tendency for this to lead to a state in which the leading edges of the paper are not lined up, and this may also lead to the paper not being transportable in a normal manner.

Thus, for scanners in which a paper tray 103 serving as a "medium placement section" is arranged at a fixed angle, as in JP-A-2014-47050, there is a need to limit the types of feedable medium and the like in order to avoid feedability being influenced by paper stiffness.

SUMMARY

An advantage of some aspects of the invention is that a medium feed device, and an image reading apparatus provided therewith, are capable of accurately feeding plural types of medium having different stiffness.

A medium feed device according to a first aspect of the invention includes a feed unit that is provided to a device body and that feeds a medium, a separator unit that is provided at a position on the device body facing the feed unit and that separates the medium, and a medium support section that supports the medium in an inclined state upstream of the feed unit. The medium support section is configured with a variable contact angle between the medium supported by the medium support section and the separator unit, and includes at least one rotatable auxiliary roller that contacts at least part of the medium and that is provided on a face supporting the medium.

The "contact angle between the medium and the separator unit" is an angle at which the medium impacts the separator unit when viewed from the side along a width direction intersecting with a medium feed direction. For example, in cases in which the separator unit is a separator roller, this is the angle formed between the medium and a tangent to the separator roller at the position where the medium hits the separator roller. Moreover, in cases in which the separator unit is a separator pad, this is the angle formed between the medium and the pad face of the separator pad.

The greater the contact angle, the smaller the resistance to paper feeding, thereby reducing concerns regarding misfeeding of the medium (non-feeds). Moreover, good feeding of medium of high stiffness can be performed. However, the smaller the contact angle, the greater the resistance to paper feeding, enabling good medium separation to be performed. This thereby enables good paper feeding to be performed for a medium that has low stiffness, such as thin paper, and is difficult to separate.

In this case, the medium support section is configured with a variable contact angle between the medium supported by the medium support section and the separator unit, and so feeding can be appropriately performed for many types of medium, from medium of high stiffness to a medium of low stiffness. Moreover, the medium can be fed smoothly due to providing, on a face supporting the medium, at least one rotatable auxiliary roller that contacts at least part of the medium.

In the medium feed device, preferably the feed unit contacts a lowermost medium from out of a plurality of medium supported by the medium support section and rotates to feed the lowermost medium.

Thus, the advantageous effects of the first aspect are obtained in a medium feed device configured to sequentially feed the lowermost medium from out of a plurality of medium supported by the medium support section.

In the medium feed device, the medium support section is preferably configured with a variable inclination angle.

This enables the contact angle between the medium supported by the medium support section and the separator unit to be changed by changing the inclination angle of the medium support section.

In the medium feed device, the medium support section is preferably provided so as to be capable of swinging with respect to the device body. This enables the inclination angle of the medium support section to be easily changed.

In the medium feed device, the auxiliary roller is preferably configured so as to be switchable between a projected state projecting out from support face and a retracted state retracted from the projected state toward the support face side.

Switching the auxiliary roller between the projected state and the retracted state enables the contact angle between the medium supported by the medium support section and the separator unit to be changed.

A medium feed device of a second aspect of the invention includes a feed unit that is provided to a device body and that feeds a medium, a separator unit that is provided at a position on the device body facing the feed unit and that separates the medium, and a medium support section that supports the medium in an inclined state upstream of the feed unit. The feed unit contacts a lowermost medium from out of a plurality of medium supported by the medium support section and rotates to feed the lowermost medium. The medium support section is interchangeably configured by a first medium support section that can be detachably attached to the device body, or a second medium support section that can be attached to the device body through an attachment that can be detachably provided to the device body. The medium support section is configured with a variable contact angle between the medium supported by the medium support section and the separator unit.

In this case, due to the medium support section being interchangeably configured by the first medium support section that can be detachably attached to the device body or a second medium support section that can be attached to the device body through an attachment that can be detachably provided to the device body, the medium support section can be made compatible with more types of medium.

In the medium feed device, preferably the attachment includes a path face between the device body and the second medium support section, the path face configuring a path for the medium.

This enables the attachment to be configured to serve the role of the path for the medium between the device body and the second medium support section.

In the medium feed device, preferably the attachment includes at least one rotatable auxiliary roller that is provided on the path face and that contacts at least part of the medium.

This enables the medium to be fed smoothly due to the attachment including at least one rotatable auxiliary roller that is provided on the path face and that contacts at least part of the medium.

In the medium feed device, preferably the second medium support section includes a rotatable auxiliary roller that is provided at an upstream end of the second medium support section in a medium feed direction and that contacts at least part of the medium.

This enables concerns to be reduced regarding damage to the medium caused by the end of the second medium support section when the medium is a long medium such that a trailing end of the medium extends beyond the second medium support section when the medium is supported by the second medium support section.

In the medium feed device, preferably the second medium support section includes a first support face that supports a first medium, and a second support face that is provided lower than the first support face and that supports a second medium of a different size than the first medium.

This enables media of different sizes to be placed on a single medium support section (the second medium support section).

In the medium feed device, preferably the second medium support section can be detachably attached to the attachment installed to the device body, and the separator unit is separated from the feed unit when the second medium support section has been installed to the attachment.

This enables a configuration to be achieved in which separation is not performed by the separator unit when the second medium support section has been installed to the attachment.

An image reading apparatus of a third aspect of the invention includes the medium feed device of the first aspect, and a read section that is provided to the device body and that is configured to read an image on the medium. The medium feed device is configured to feed the medium toward the read section.

This enables similar operation and advantageous effects to those of the first aspect to be obtained in a medium feed device that feeds the medium toward the read section in an image reading apparatus.

The image reading apparatus preferably further includes an alert unit that prompts a change in the contact angle between the medium supported by the medium support section and the separator unit based on a type of the medium being fed.

This enables a user to be prompted to change the contact angle between the medium supported by the medium support section and the separator unit according to the type of the medium being fed. Hence, better ensuring appropriate medium feeding is executed.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Explanation first follows regarding an outline of an image reading apparatus according to a first embodiment of the invention. As an example of an image reading apparatus according to the present embodiment, an example will be given of a document scanner 1 (hereafter referred to simply as the scanner 1) capable of reading at least one face out of the front face or the back face of a medium.

Figure 1:
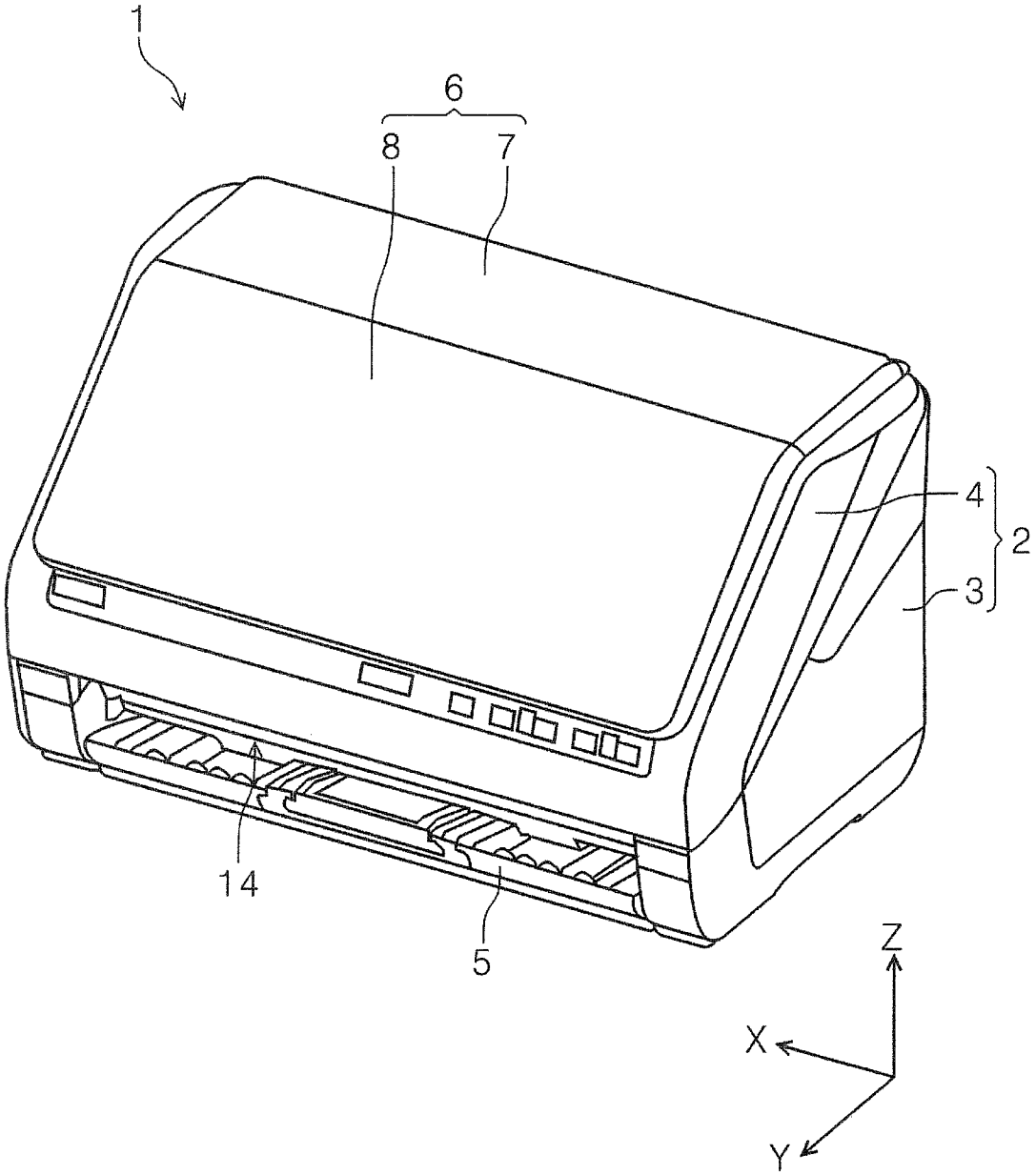
FIG. 1 is an external perspective view illustrating a scanner according to a first embodiment.
Figure 2:
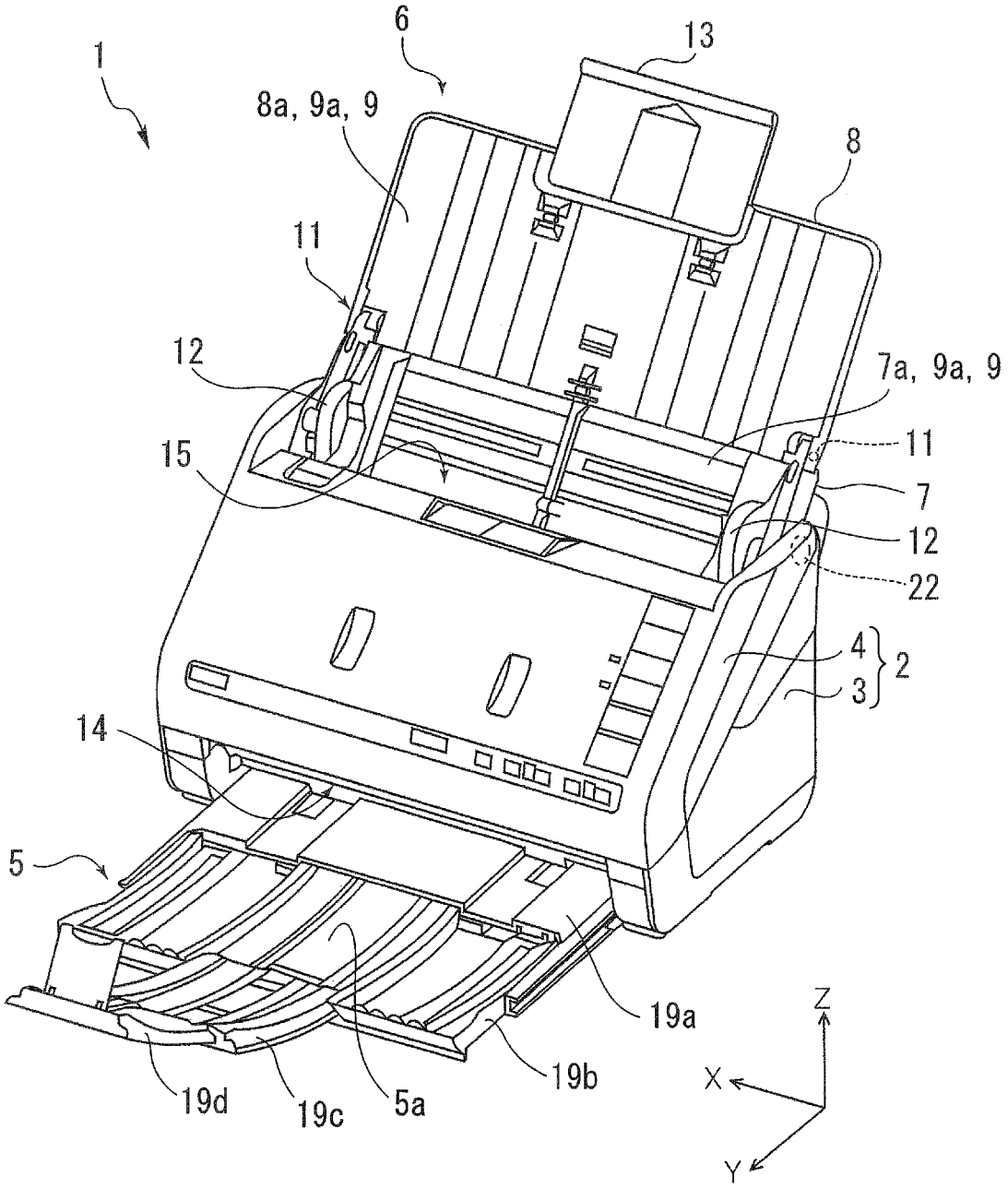
FIG. 2 is a perspective view illustrating a scanner according to the first embodiment in a state in which a top cover is open and an output tray is pulled out.
Figure 3:
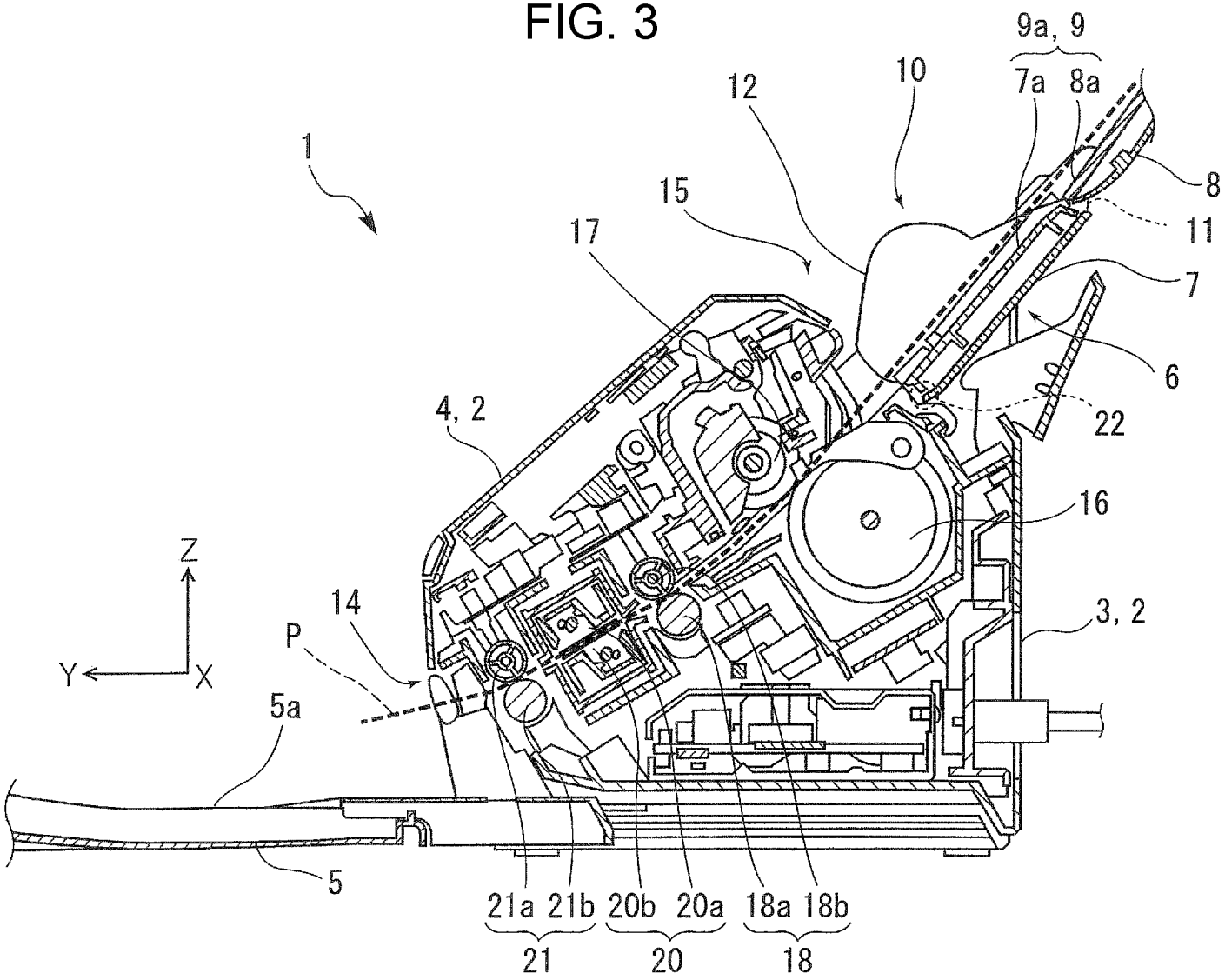
FIG. 3 is a sideways section of the scanner illustrated in FIG. 2, illustrating a paper transport path.
Figure 4:
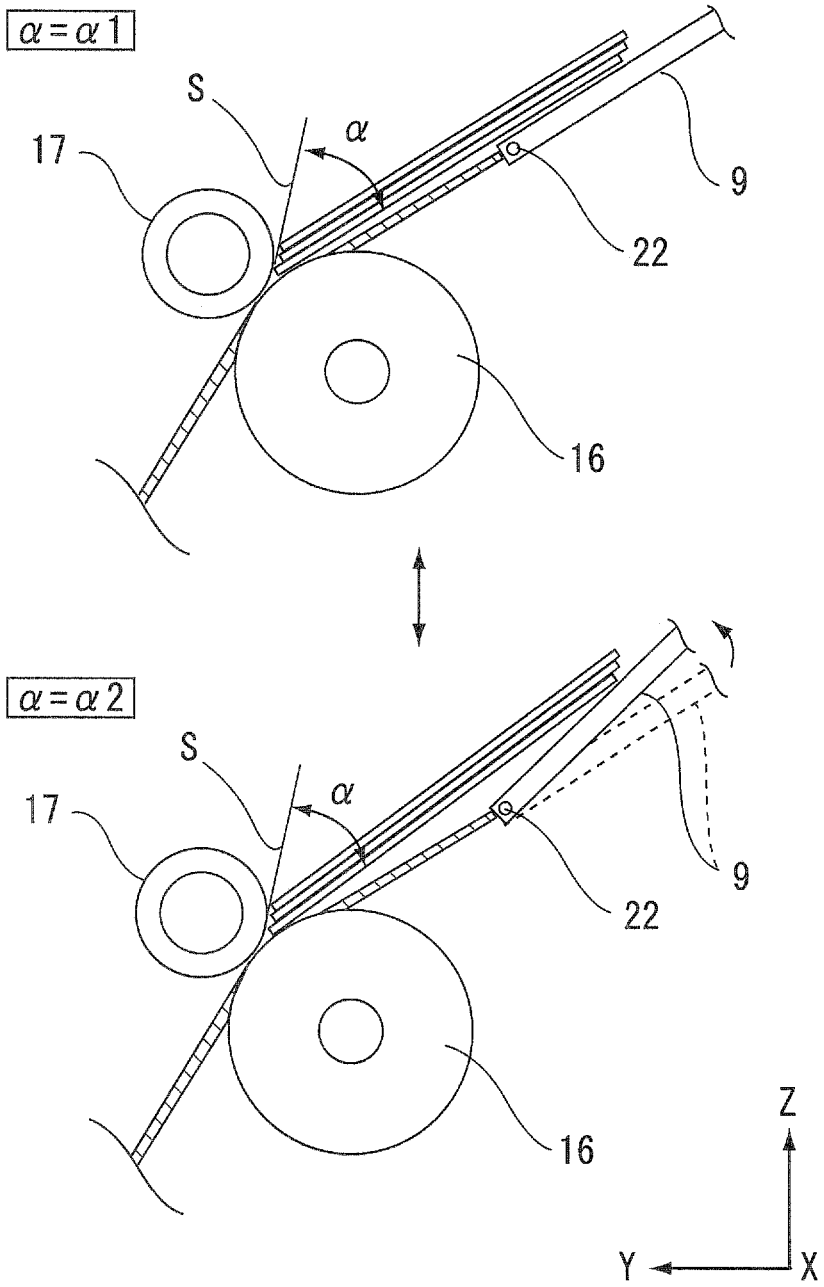
FIG. 4 is a diagram to explain a contact angle between paper and a separator roller.
Figure 5:
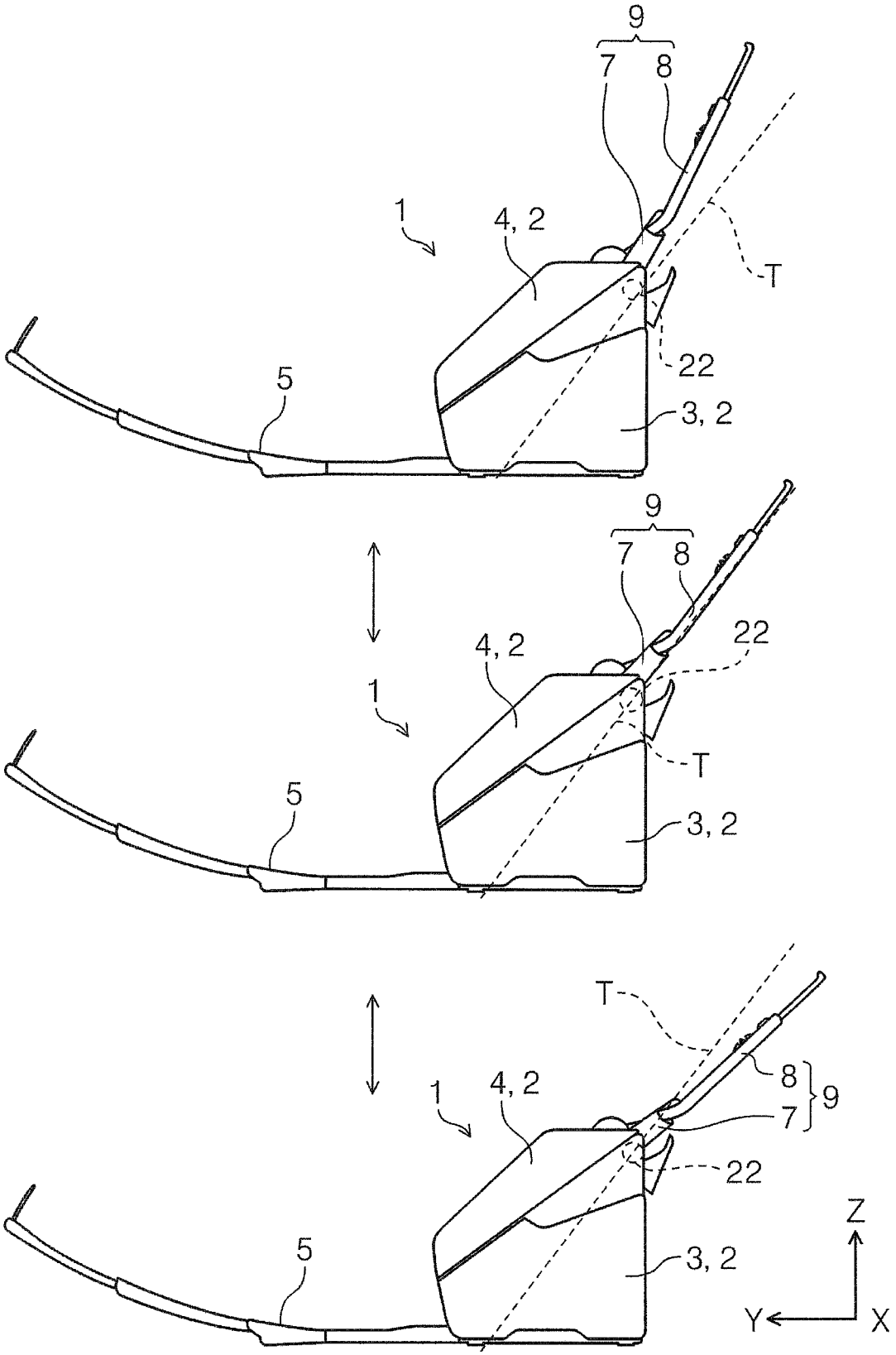
FIG. 5 is a diagram illustrating altered states of an angle of inclination of a medium support section.
Figure 6:
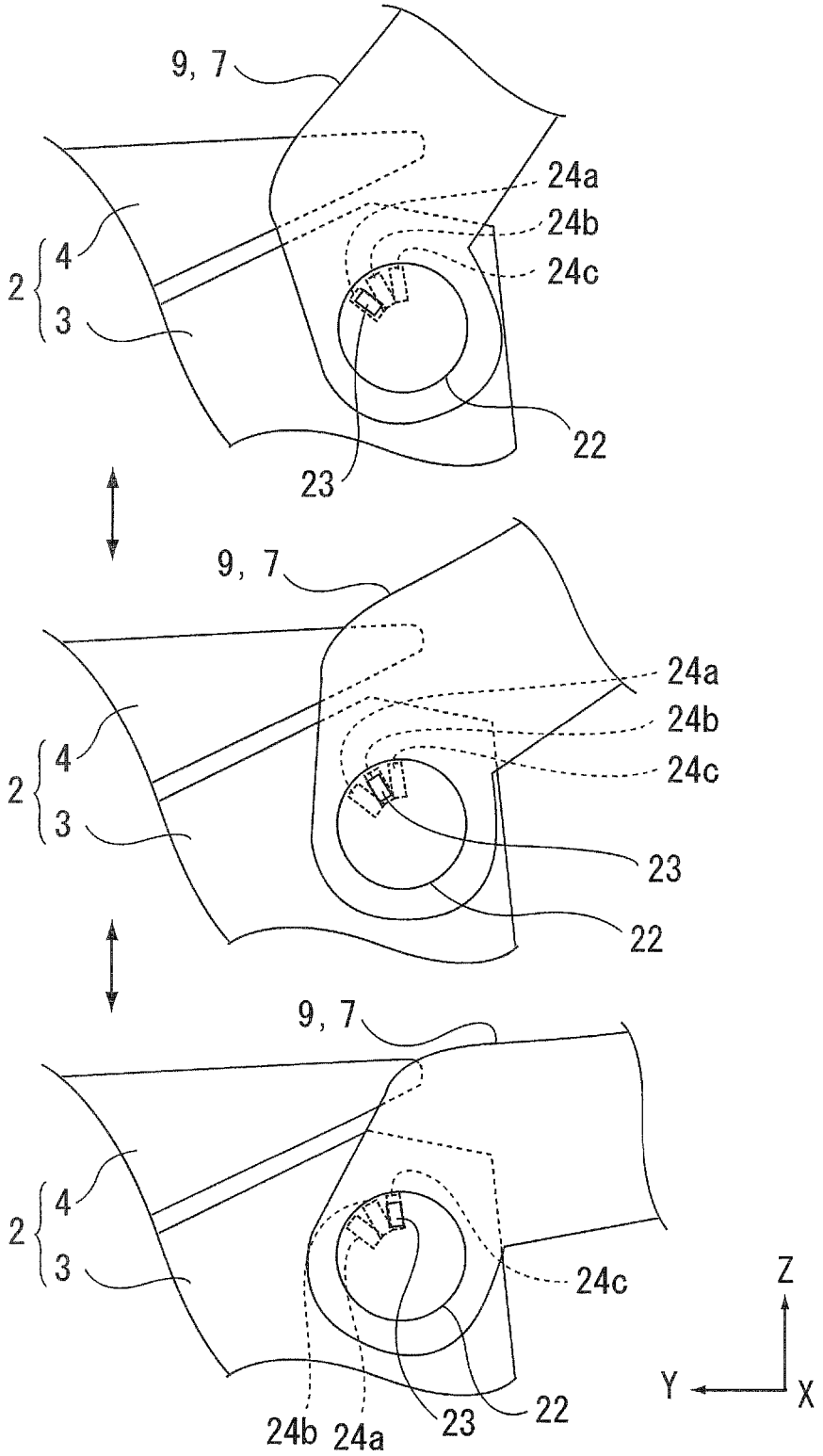
FIG. 6 is a diagram for explaining a mechanism for switching a medium support section inclination angle.

FIG. 1 is an external perspective view illustrating a scanner according to the first embodiment. FIG. 2 is a perspective view illustrating a scanner according to the first embodiment in a state in which a top cover is open and an output tray is pulled out. FIG. 3 is a sideways section of the scanner illustrated in FIG. 2, and is a diagram illustrating a paper transport path. FIG. 4 is a diagram to explain a contact angle between paper and a separator roller. FIG. 5 is a diagram illustrating changed states of an angle of inclination of a medium support section. FIG. 6 is a diagram to explain a mechanism to switch an inclination angle of a medium support section.

Note that in the X-Y-Z coordinate system illustrated in the drawings, the X direction is the device width direction which is also the paper width direction, the Y direction is the device depth direction, and the Z direction is the device height direction.

The +Y direction side is the device front face side, and the −Y direction side is the device rear face side. The +X direction is the left side and the −X direction is the right side when looking at the device from the front face side. Moreover, the +Z direction is the device upside (including an upper section, a top face, etc. thereof), and the −Z direction side is the device downside (including a lower section, a bottom face, etc. thereof).

In the scanner 1, the paper transport direction is inclined from the device upper rear face side to the device lower front face side. However, since the scanner 1 basically is configured so as to transport paper from the device rear face side toward the device front face side, explanation follows with the Y axis direction as the paper transport direction. In the following, the direction that paper P is transported toward (the +Y direction side) is referred to as "downstream", and the opposite direction thereto (the −Y direction side) is referred to as "upstream".

Outline of Scanner

Explanation follows regarding an outline of the scanner 1, with reference to FIGS. 1 to 3.

The scanner 1 according to the invention (FIGS. 1 to 3) includes a device body 2 equipped with a read section 20 (FIG. 3) that reads images on paper P, serving as a "medium", and a medium feed device 10 (FIG. 3) that feeds the paper P toward the read section 20. The scanner 1 also includes a top cover 6 to open/close the device body 2.

The device body 2 is configured including a lower unit 3 and an upper unit 4. The upper unit 4 is attached to the lower unit 3 so as to be capable of swinging with a paper transport direction downstream side of the lower unit 3 acting as a swing point. The paper transport path for the paper P is exposed when the upper unit 4 is opened to the device front face side of the lower unit 3. This is a situation in which clearing of paper P jams and maintenance of a feed roller 16, a transport roller pair 18, and the like, described later, is facilitated.

The top cover 6 provided to an upper portion of the device body 2 is attached to the lower unit 3 so as to be capable of swinging with respect to an upper portion on the rear face side of the lower unit 3.

More specifically, the top cover 6 is configured including a first cover section 7 and a second cover section 8, with the first cover section 7 and the second cover section 8 connected together by a swing shaft 11 (see FIG. 2 and FIG. 3). The first cover section 7 is attached to the lower unit 3 so as to be capable of swinging with respect to an upper portion on the rear face side of the lower unit 3, and the top cover 6 opens/closes the upper portion of the upper unit 4.

A medium setting section 15 (FIG. 2) provided at an upper portion of the device body 2 is exposed when the top cover 6 is open, as illustrated in FIG. 2. The medium setting section 15 is a paper insertion port for setting paper P in the medium feed device 10, described later.

The top cover 6 adopts a non-feed state covering the upper portion of the upper unit 4 as illustrated in FIG. 1, and a feed state, as illustrated in FIG. 2, in which the top cover 6 is swung from the non-feed state of FIG. 1 toward the device rear face side, thereby opening the medium setting section 15 and enabling the paper P to be set in the medium feed device 10. In the feed state, the back face of the top cover 6 (a back face 7*a* of the first cover section 7 and a back face 8*a* of the second cover section 8) become a support face 9*a* of a medium support section 9 of the medium feed device 10, with the support face 9*a* supporting the set paper P.

In the feed state illustrated in FIG. 2, the top cover 6 opens so that the back face 7*a* of the first cover section 7 and the back face 8*a* of the second cover section 8 are disposed in the same plane as each other. In the non-feed state illustrated in FIG. 1, the second cover section 8 swings in the closing direction about an axis of the swing shaft 11, specifically, the top cover 6 closes so as to follow the profile of the upper portion of the upper unit 4.

Moreover, the reference sign 13 in FIG. 2 indicates an auxiliary paper support 13. The auxiliary paper support 13 can be stowed within the second cover section 8, and is provided so as to be capable of being pulled out from the second cover section 8. The length of the support face 9*a* of the medium support section 9 can be varied by extending or contracting the auxiliary paper support 13 so as to pull the auxiliary paper support 13 out or stow the auxiliary paper support 13.

The paper P is set in the medium feed device 10 (see FIG. 3) through the medium setting section 15. The medium feed device 10 includes the feed roller 16 serving as a "feed unit" that feeds the paper P, a separator roller 17 serving as a "separator unit", described later, and the medium support section 9 including the support face 9*a*. The medium support section 9 is positioned upstream of the feed roller 16 and supports plural sheets of source document (paper P) to be fed toward the read section 20.

A pair of edge guides 12 (FIG. 2) are provided to the back face 7*a* of the first cover section 7, serving as the medium support section 9. The edge guides 12 guide edges of the paper P placed on the support face 9*a* of the medium support section 9, the edges being at the sides of the paper P in a width direction (X axis direction) intersecting with the paper P feed direction.

The pair of edge guides 12 are configured so as to be capable of sliding in an X axis direction to match paper P of different widths (X axis direction lengths).

An output unit 14 and a paper output tray 5 are provided at the device front face side of the lower unit 3. The output unit 14 is an opening for discharging the paper P from inside the device body 2. The paper output tray 5 receives the paper P discharged through the output unit 14.

The paper output tray 5 is able to adopt two states: a stowed state stowed in the output unit 14, as illustrated in FIG. 1, and a pulled-out state, pulled out from the output unit 14 toward the device front face side, as illustrated in FIG. 2. Moreover, in the present embodiment, the paper output tray 5 is configured by plural connected tray members 19*a*, 19*b*, 19*c*, 19*d* (FIG. 2). The length of the output paper tray 5 pulled out from the output unit 14 is adjustable according to the length of the paper P being output.

Note that, instead of the output paper tray 5 being a pull-out type as in the present embodiment (also referred to as an insertion type, or telescopic type), the output paper tray 5 may be a foldable type, in which plural tray members are stowed by being folded away, and are capable of being unfolded and deployed with an adjustable length when in use.

Paper Transport Path of Scanner

Explanation follows regarding a paper transport path in the scanner 1, with reference to FIG. 3.

The paper P set in the medium setting section 15 is placed on the medium support section 9, in which the back face of the top cover 6 (the back face 7*a* of the first cover section 7 and the back face 8*a* of the second cover section 8) is in an orientation swung toward the device rear face side with respect to the lower unit 3. The back face of the top cover 6 serves as the support face 9*a*. Plural sheets of the paper P can be set in the medium support section 9. Note that a more detailed description of the medium support section 9 will be given after describing the paper transport path.

The paper P placed on the medium support section 9 is picked up by the feed roller 16 and fed downstream (toward the +Y direction side). The feed roller 16 is provided so as to be capable of rotating with respect to the lower unit 3 (the device body 2). More specifically, the lowermost sheet of paper P, from out of plural sheets of the paper P supported by the medium support section 9, is fed downstream by the feed roller 16 contacting the back face of the lowermost sheet of paper P, namely, the face of the paper P facing the support face 9*a*, and the feed roller 16 rotating. The feed roller 16 is disposed such that a portion of the feed roller 16 projects out into the paper transport path.

Note that the medium feed device 10 of the present embodiment has a configuration to feed plural sheets of the paper P supported by the medium support section 9 in sequence from the bottom. However, for example, the medium feed device 10 may have a configuration with the feed roller 16 provided in the upper unit 4 to feed from the uppermost sheet of paper.

The separator roller 17 is provided at a position in the upper unit 4 (the device body 2) facing the feed roller 16, and serves as a "separator unit" to separate the paper P. Paper multi-feeds are suppressed by a predetermined rotation resistance being imparted to the separator roller 17. If two or more sheets of the paper P start to enter between the feed roller 16 and the separator roller 17, the paper on the upper side is separated by the separator roller 17, and only the paper in contact with the feed roller 16 is nipped between the feed roller 16 and the separator roller 17 and fed downstream in the feed direction.

The outer circumferential faces of the feed roller 16 and the separator roller 17 are configured by a high friction material (for example, an elastomer such as rubber or the like). Note that the "separator unit" is not limited to being a roller and, for example, a separator pad with a face formed from a high friction material may be employed.

The transport roller pair 18, the read section 20, and a discharge roller pair 21 are provided at the transport direction downstream side of the feed roller 16.

In the present embodiment, the discharge roller pair 21 includes a discharge drive roller 21*a* provided to the lower unit 3, and a discharge following roller 21*b* that is provided to the upper unit 4 and that follows the rotation of the discharge drive roller 21*a*.

The paper P nipped by the feed roller 16 and the separator roller 17 and fed to the transport direction downstream side is nipped by the transport roller pair 18, and is transported to the read section 20 positioned downstream of the transport roller pair 18.

The transport roller pair 18 includes a transport drive roller 18*a* provided to the lower unit 3, and a transport following roller 18*b* that is provided to the upper unit 4 and that follows the rotation of the transport drive roller 18*a*.

Note that in the present embodiment, the feed roller 16, the transport drive roller 18*a*, and the discharge drive roller 21*a* are rotationally driven by a non-illustrated drive source provided inside the lower unit 3.

Moreover, the feed roller 16, the separator roller 17, and the transport roller pair 18 are arranged at central portions in the width direction (X axis direction) intersecting the medium transport direction. Positioning of the paper P is performed with reference to the width direction center of the paper P, in a configuration referred to as center sheet feeding. Thus, the discharge roller pair 21 is also provided at an X axis direction center portion.

The read section 20 includes an upper read sensor 20*a* provided on the upper unit 4 side, and a lower read sensor 20*b* provided on the lower unit 3 side. In the present embodiment, the upper read sensor 20*a* and the lower read sensor 20*b* configure, for example, a contact image sensor module (CISM).

After an image has been read from at least one out of the front face or the back face of the paper P in the read section 20, the paper P is then nipped by the discharge roller pair 21 positioned downstream of the read section 20 and discharged toward the output paper tray 5 from the output unit 14. Note that broken line in FIG. 3 indicates the paper P being fed along the paper transport path in the scanner 1.

Medium Support Section of Medium Feed Device

Detailed description will now be given regarding the medium support section 9 of the medium feed device 10.

As illustrated in FIG. 3, the medium support section 9 supports the paper P in an inclined state upstream of the feed roller 16 (feed unit).

The medium support section 9 is configured with a variable "contact angle α" between the paper P supported by the medium support section 9 and the separator roller 17. Explanation follows regarding the contact angle α, with reference to FIG. 4.

The contact angle α of the paper P with respect to the separator roller 17 is the angle at which the paper P impacts the separator roller 17 in side view along the width direction (X axis direction) intersecting the medium feed direction illustrated in FIG. 4, this being the angle formed between the paper P and a tangent to the separator roller 17 at the position where the paper P touches the separator roller 17 (indicated by the reference sign S in FIG. 4).

Note that a case in which the contact angle α is a large α1 (α=α1) is illustrated at the top of FIG. 4, and a case in which the contact angle α is α2 smaller than contact angle α1 (α=α2<α1) is illustrated at the bottom of FIG. 4.

The paper P serving as the source document to be read by the scanner 1 may be paper of many quality types and, in particular, the ability to separate the paper P with the separator roller 17 changes according to differences in the stiffness of the paper P. The appropriate contact angle α therefore also differs according to differences in the stiffness of the paper P.

When the medium support section 9 is disposed at a fixed angle, this limits the types of appropriately feedable paper due to the contact angle α also being fixed.

In the medium support section 9 of the present embodiment, the contact angle α between the paper P supported by the medium support section 9 and the separator roller 17 is variable, enabling the contact angle α to be changed according to the type of the paper P (the stiffness type of the paper P) and paper P of various types to be fed appropriately.

For example, in cases in which paper P is a medium of high stiffness, such as card stock, the resistance to paper feeding at the separator roller 17 can be made small by making the contact angle α large as illustrated at the top of FIG. 4, enabling concern regarding mis-feeds (non-feeds) of the paper P to be reduced. Hence, good feeding can be achieved for paper P of high stiffness.

In cases in which a medium of low stiffness that is difficult to separate is employed, such as thin paper P, by making the contact angle α small as illustrated at the bottom of FIG. 4, the resistance to feeding is increased, and good separation and feeding can be achieved with the paper P of low stiffness.

Changing the contact angle α with respect to the separator roller 17 in this manner enables various types of paper P to be appropriately fed.

In the present embodiment, the contact angle between the paper P supported by the medium support section 9 and the separator roller 17 can be changed by changing the inclination angle of the medium support section 9.

More specifically, the medium support section 9 is able to adopt a normal state as illustrated in the center of FIG. 5, a steep state having a greater inclination angle than in the normal state (FIG. 5 top), and a gentle state having a lesser inclination angle than in the normal state (FIG. 5 bottom). Note that the broken line illustrated by reference sign T in each part of FIG. 5 indicates the inclination angle of the medium support section 9 with respect to the normal state.

Switching Inclination Angle of Medium Support Section

As stated above, the medium support section 9 is provided so as to be capable of swinging with respect to the lower unit 3 configuring the device body 2, and so the inclination angle can be changed by swinging the medium support section 9.

Switching of the inclination angle of the medium support section 9 can be performed by, for example as illustrated in FIG. 6, providing an engagement protrusion 23 on a swing shaft 22 of the medium support section 9, providing plural engagement indentations 24*a*, 24*b*, 24*c* on the lower unit 3 (the device body 2), and switching the engagement indentation the engagement protrusion 23 of the swing shaft 22 engages with.

In the present embodiment, the normal state is a state in which the engagement protrusion 23 of the swing shaft 22 engages with the engagement indentation 24*b* (FIG. 5 center, FIG. 6 center), the greatest inclination angle is when the engagement protrusion 23 engages with the engagement indentation 24*a* (FIG. 5 top, FIG. 6 top), and the smallest inclination angle is when the engagement protrusion 23 engages with the engagement indentation 24*c* (FIG. 5 bottom, FIG. 6 bottom).

As described above, the inclination angle can be easily changed by swinging the medium support section 9.

Note that other than switching the inclination angle of the medium support section 9 between a number of prescribed angles as described in the present embodiment, configuration may also be made such that the inclination angle of the medium support section 9 is changed to any given angle.

Second Embodiment

Figure 7:
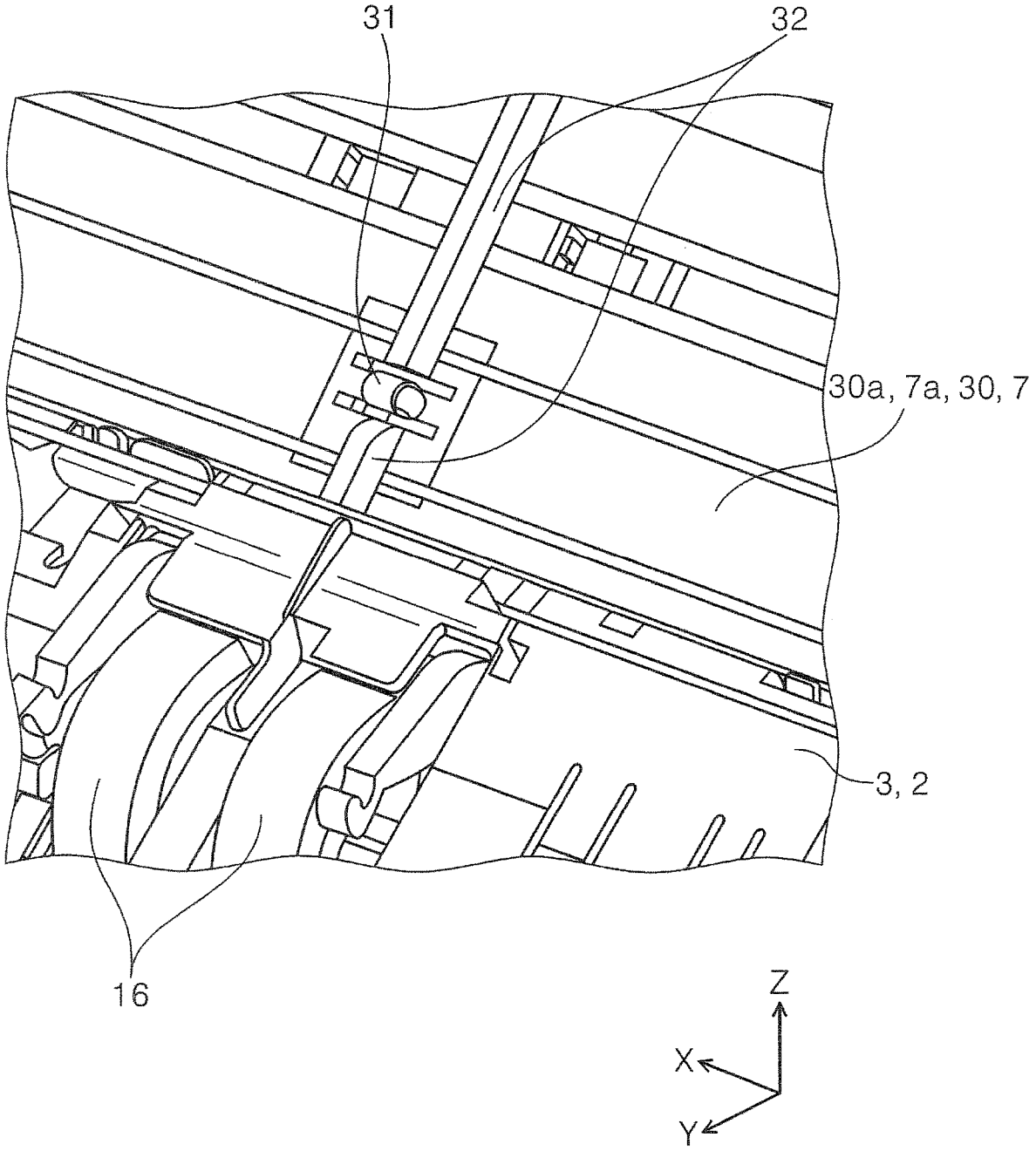
FIG. 7 is an enlarged view of relevant portions of a medium support section according to a second embodiment.
Figure 8:
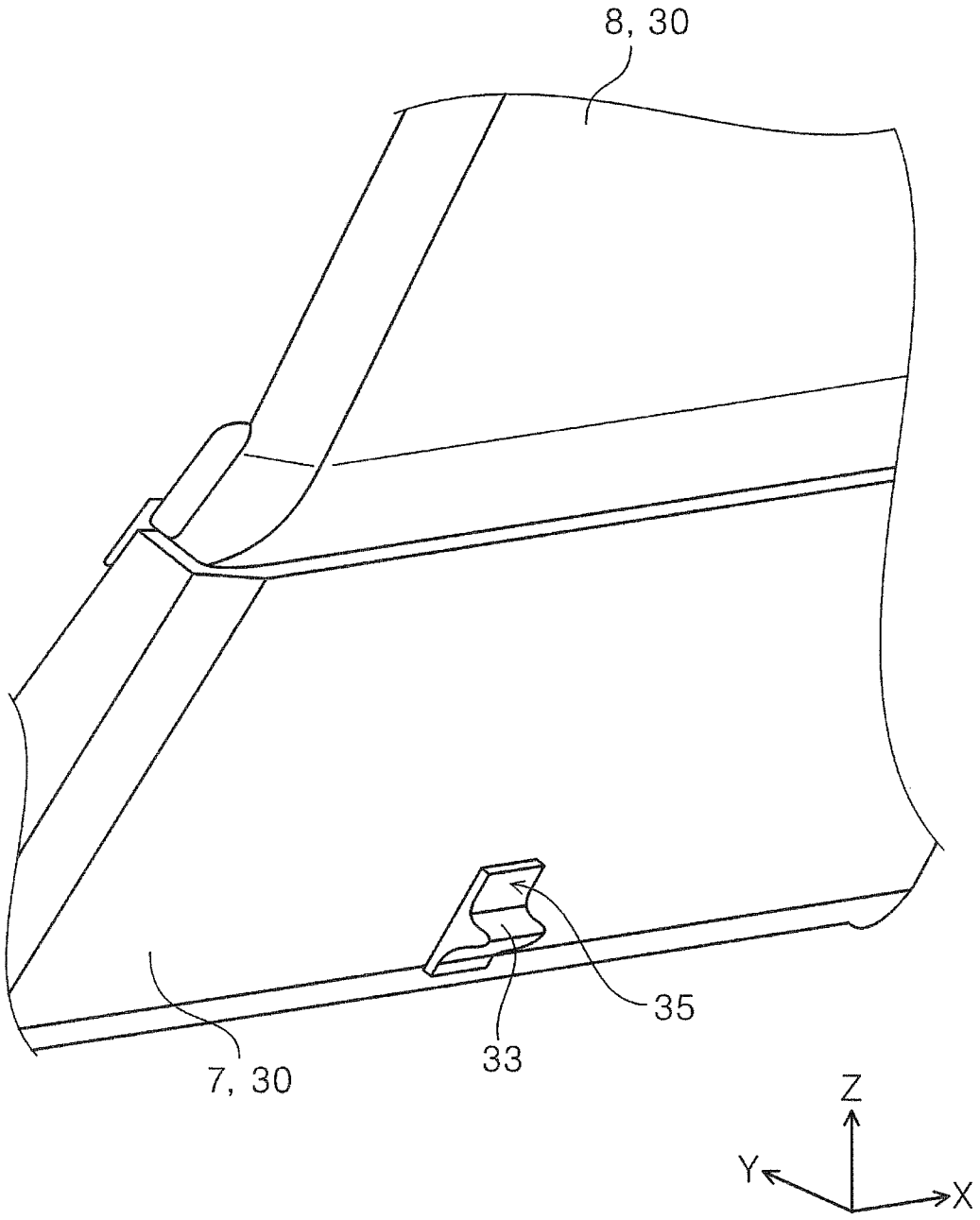
FIG. 8 is a diagram illustrating a switching lever provided on a top cover.
Figure 9:
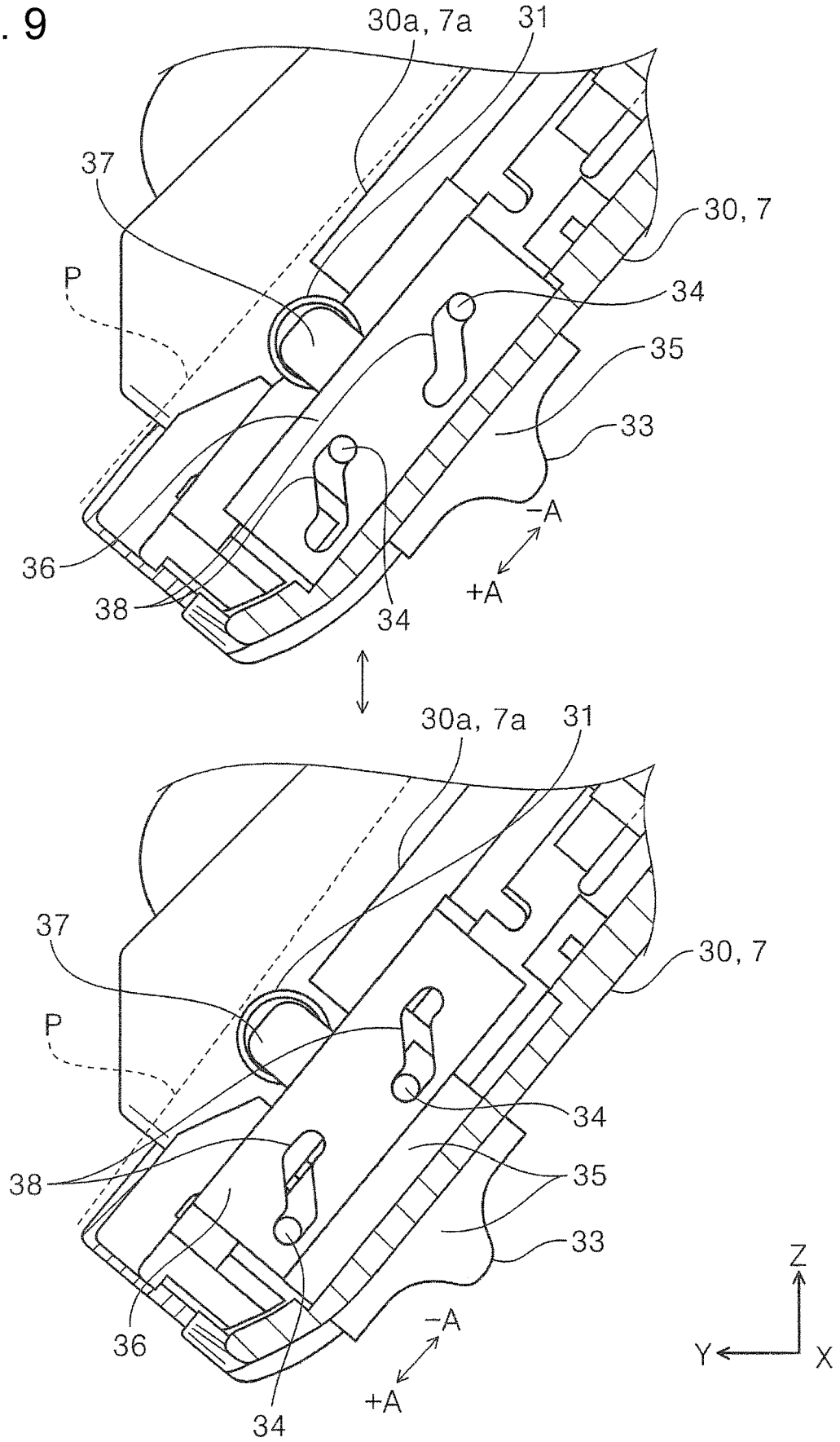
FIG. 9 is a diagram for explaining a mechanism to switch a state of an auxiliary roller.

A second embodiment is described, mainly with reference to FIG. 7 to FIG. 9, as another example of a medium support section in the medium feed device. FIG. 7 is an enlarged view of relevant portions of a medium support section according to the second embodiment. FIG. 8 is a diagram illustrating a switching lever provided on a top cover. FIG. 9 is an explanatory diagram of a mechanism to switch a state of an auxiliary roller.

In the present embodiment, the same reference signs are appended to configuration the same as that of the first embodiment, and description thereof is omitted.

Similarly to in the first embodiment, in the present embodiment, a top cover 6 (a first cover section 7 and a second cover section 8, see FIG. 2) functions as a medium support section 30 when in an open state. In the medium support section 30, a support face 30*a* to support the paper P is configured by a back face 7*a* of the first cover section 7 and a back face 8*a* of the second cover section 8.

The medium support section 30 is also provided with at least one rotatable auxiliary roller 31 (FIG. 7). The auxiliary roller 31 is provided on a support face 30*a* for the paper P and contacts at least part of the paper P.

More specifically, the least one rotatable auxiliary roller 31 is provided inside the first cover section 7 and the second cover section 8 configuring the medium support section 30. The at least one auxiliary roller 31 is provided at a center portion of the back face 7*a* of the first cover section 7 in the device width direction (X axis direction).

The paper P can be fed smoothly due to providing the auxiliary roller 31 to the support face 30*a* of the medium support section 30. Plural of the auxiliary rollers 31 may be provided, and is such cases, the plural auxiliary rollers 31 are preferably arranged symmetrically about the device width direction center portion of the support face 30*a*. The back face 8*a* of the second cover section 8 (FIG. 2) may also be provided as the support face 30*a* of the medium support section 30.

Note that, as illustrated in FIG. 7, ribs 32 are provided at a device width direction center portion of the support face 30*a* of the medium support section 30 of the present embodiment, with the ribs 32 extending in a direction along the medium feed direction (Y axis direction). The ribs 32 are provided at the same position in the device width direction as the auxiliary roller 31. Provision of the ribs 32 reduces the contact resistance of the paper P at the support face 30*a*, enabling smooth feeding of the paper P to be achieved.

Moreover, the auxiliary roller 31 is configured so as to be switchable between a projected state projecting out from the support face 30*a*, as illustrated at the bottom of FIG. 9, and a retracted state retracted from the projected state toward the support face 30*a* side, as illustrated at the top of FIG. 9.

In the retracted state of the auxiliary roller 31 (top of FIG. 9), the paper P is supported at an angle along the inclination of the support face 30*a* of the medium support section 30. In the projected state of the auxiliary roller 31 (bottom of FIG. 9), at least part of the paper P is supported by the auxiliary roller 31 at an angle steeper than the inclination of the support face 30*a*.

As described above, the inclination angle of the paper P changed as illustrated at the top and bottom of FIG. 9 by switching the auxiliary roller 31 between the projected state and the retracted state, thereby enabling the contact angle α between the paper P and the separator roller 17 downstream of the medium support section 30 to be changed.

Thus the contact angle α can be changed according to the type of the paper P (the stiffness type of the paper P), enabling many types of paper P to be fed appropriately.

Mechanism to Switch Auxiliary Roller State

Next, a description follows regarding a switching mechanism to switch the state of the auxiliary roller 31 between the projected state and the retracted state.

Switching of the state of the auxiliary roller 31 is executed by moving a switching lever 33 provided to the first cover section 7.

More specifically, the switching lever 33 is provided as a single body with a cam 35 equipped with protrusions 34, in a configuration in which the switching lever 33 is slidable along the first cover section 7. The directions indicated by the double-headed arrows in FIG. 9 are the slide directions of the switching lever 33, and the slide directions are indicated by a +A and a −A slide direction. The auxiliary roller 31 is attached to a shaft bearing 37 provided to a cam follower 36 so as to be capable of swinging, and the cam follower 36 is equipped with cam grooves 38 that are engaged by the protrusions 34 of the cam 35.

As illustrated at the top of FIG. 9, the auxiliary roller 31 adopts the retracted state when the protrusions 34 of the cam 35 are positioned at the top edge of the cam grooves 38 of the cam follower 36. When the switching lever 33 is slid in the +A direction, the cam follower 36 is raised upwards accompanying movement of the protrusions 34 of the cam 35 to the bottom edge of the cam grooves 38, as illustrated at the bottom of FIG. 9. The auxiliary roller 31 thereby adopts the projected state.

The switch from the projected state to the retracted state can be performed by sliding the switching lever 33 in the opposite direction, namely in the −A direction.

Note that other than cases in which switching of the state of the auxiliary roller 31 is performed manually using the switching lever 33 and so on, for example, a configuration may be adopted in which the switching is performed automatically based on driver information regarding the type of medium or the like set by a user.

Third Embodiment

Explanation follows regarding another example of a medium feed device according to a third embodiment of the invention, and scanner equipped with the same, with reference to FIG. 10 to FIG. 20.

Figure 10:
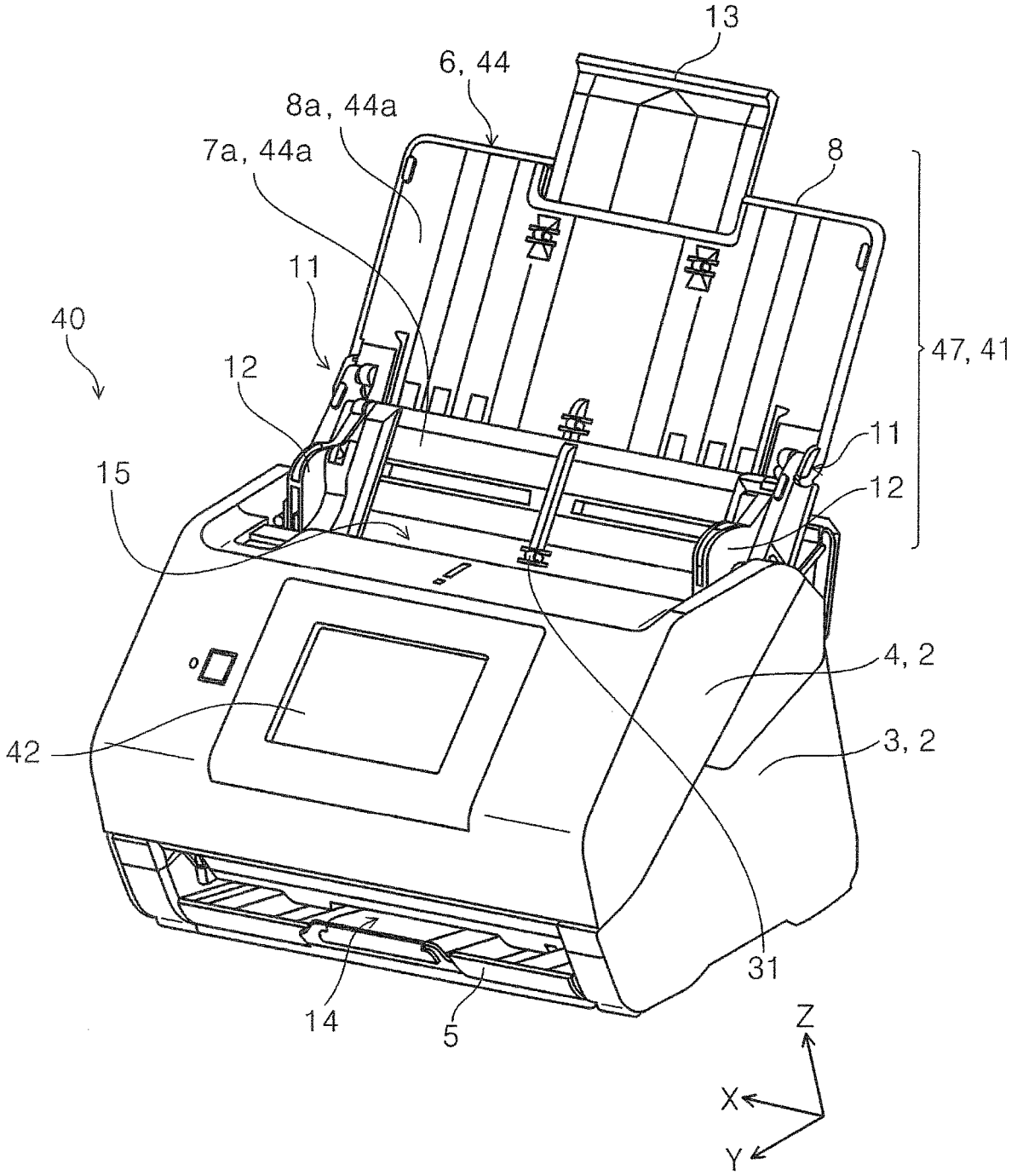
FIG. 10 is an external perspective diagram illustrating a state in which a first unit body is attached to a scanner according to a third embodiment.
Figure 11:
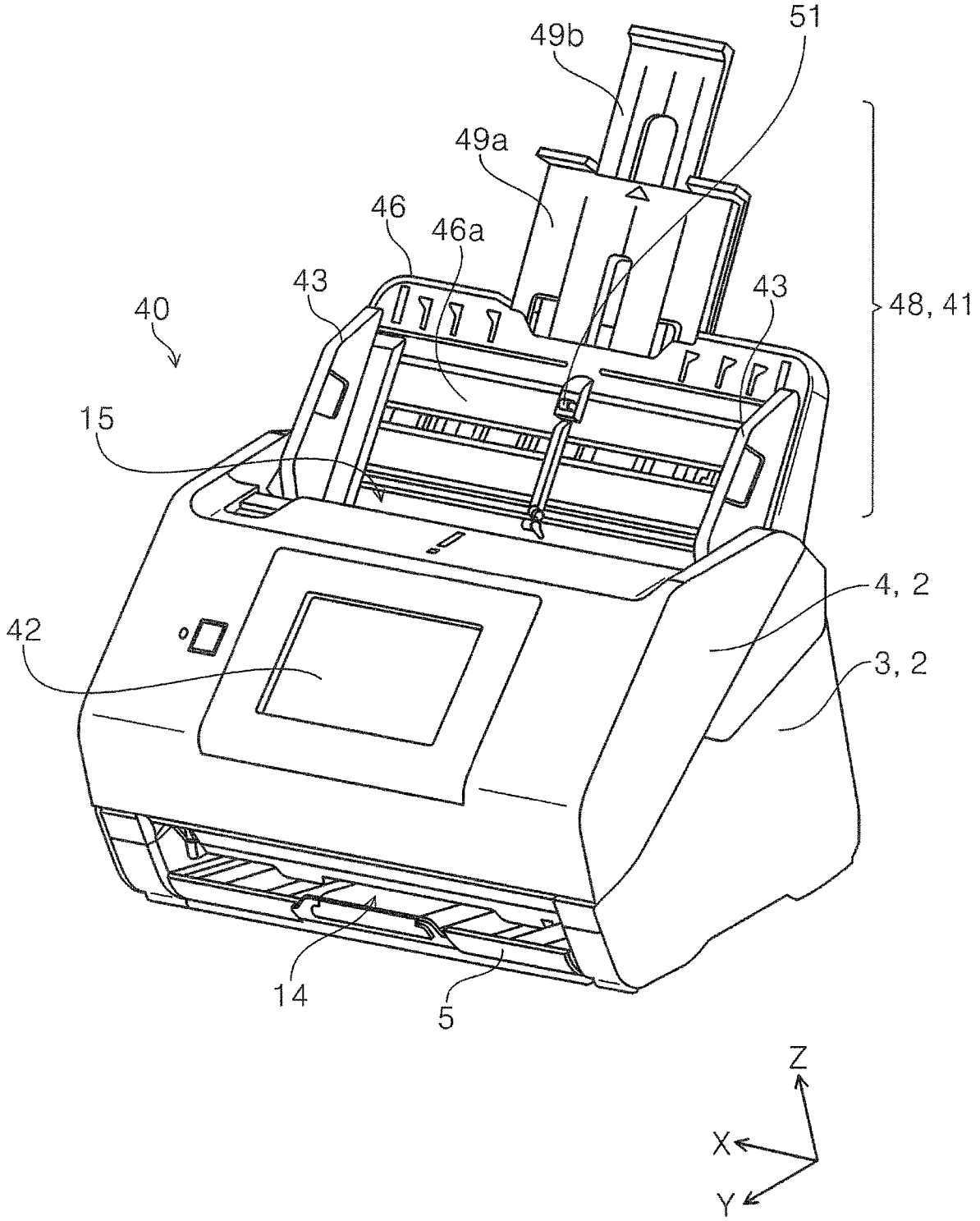
FIG. 11 is an external perspective diagram illustrating a state in which a second unit body in the scanner according to the third embodiment.
Figure 12:
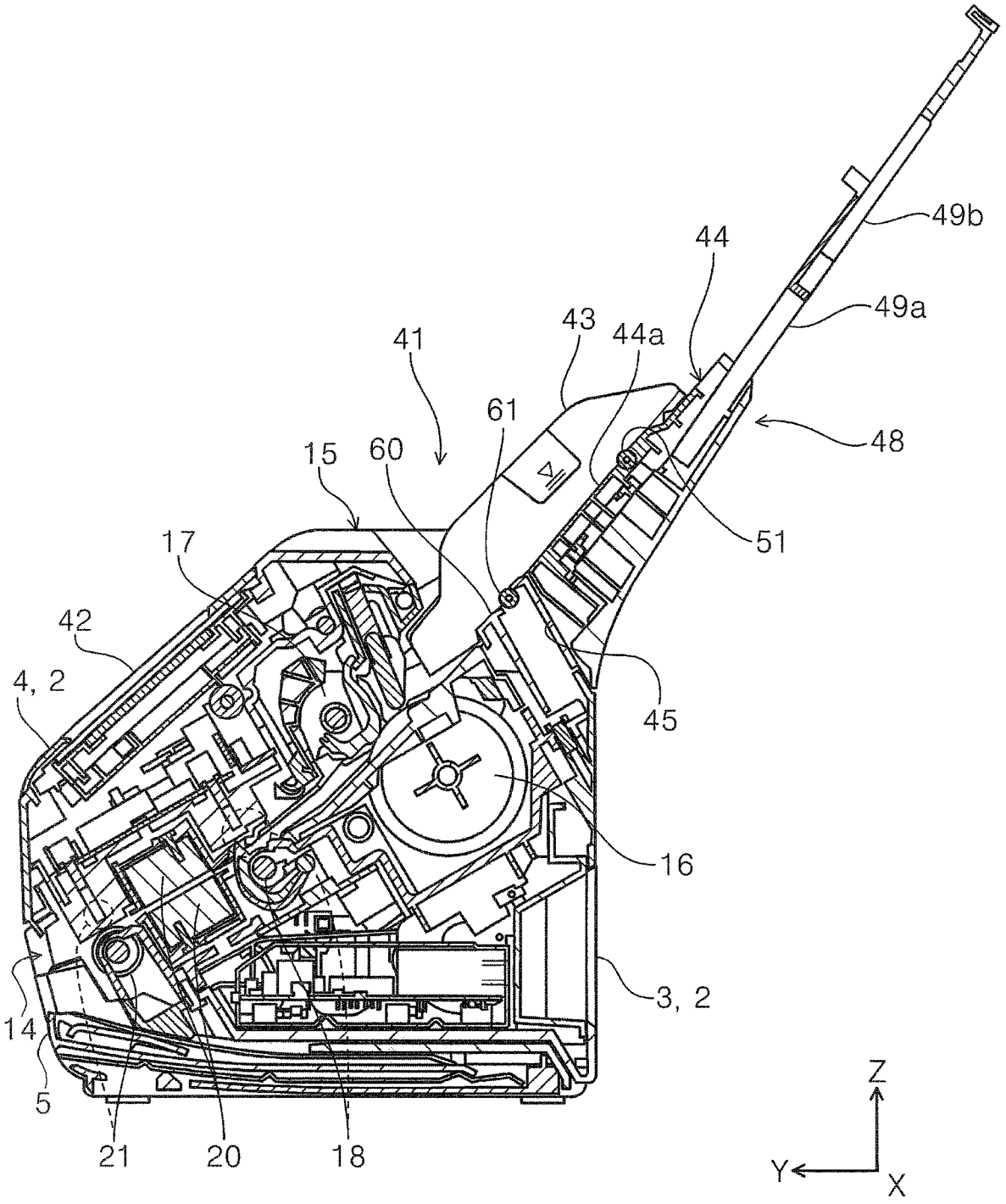
FIG. 12 is a sideways section of the scanner illustrated in FIG. 11.
Figure 13:
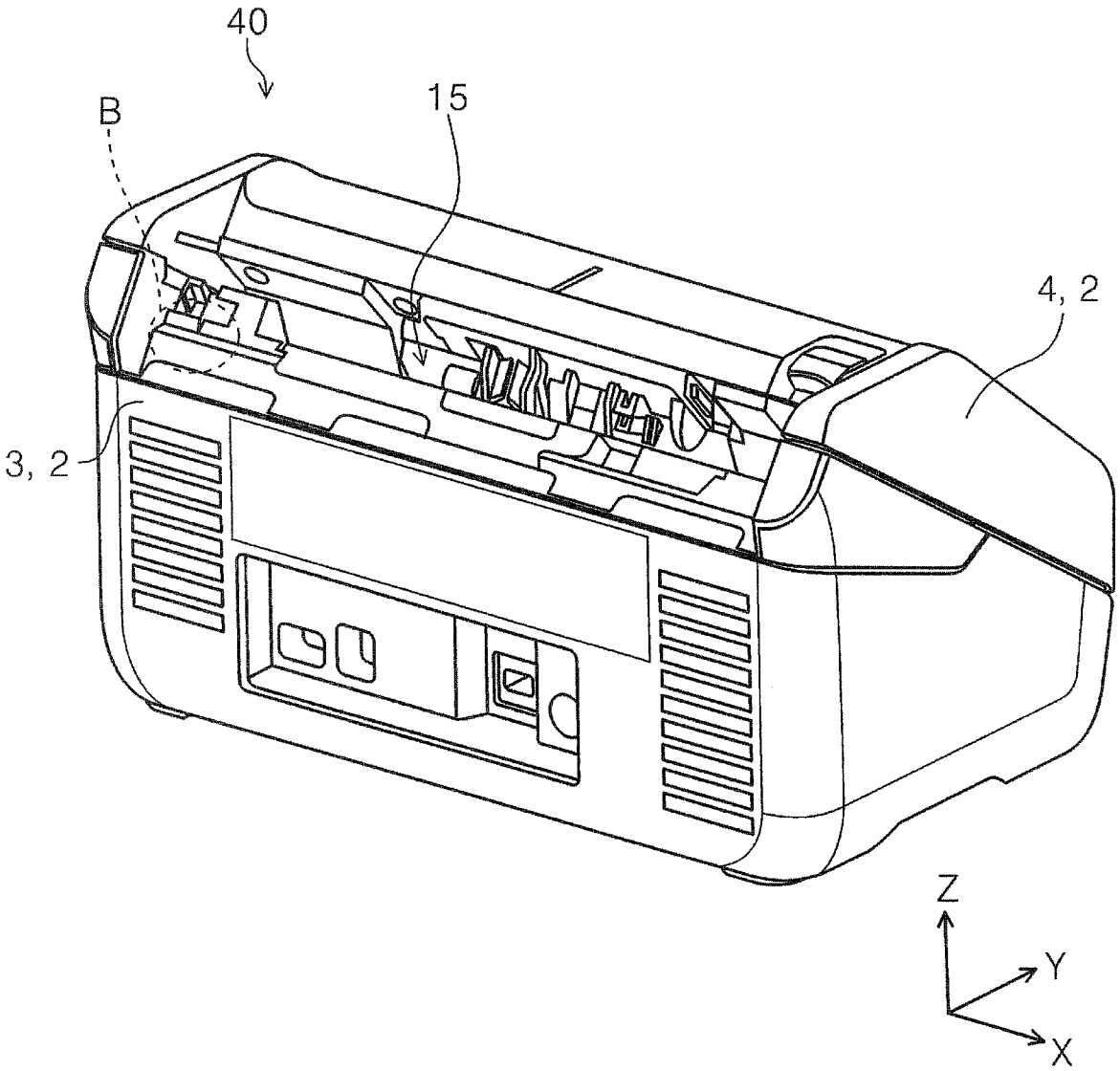
FIG. 13 is a perspective view of the scanner illustrated in FIG. 10 in a state in which the first unit body has been detached from the scanner, as viewed from a device rear face side.
Figure 14:
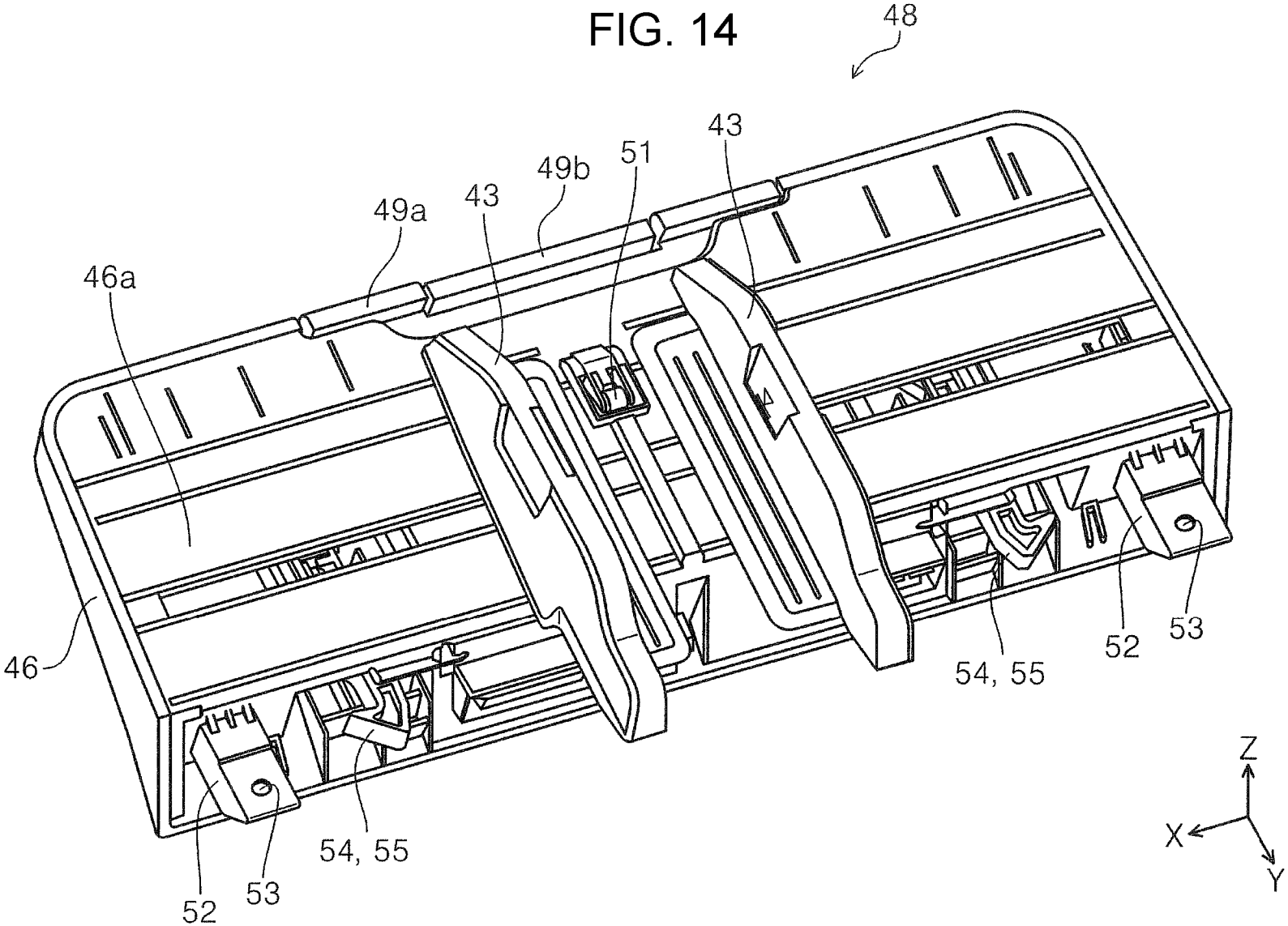
FIG. 14 is an external perspective view of a second unit body.
Figure 15:
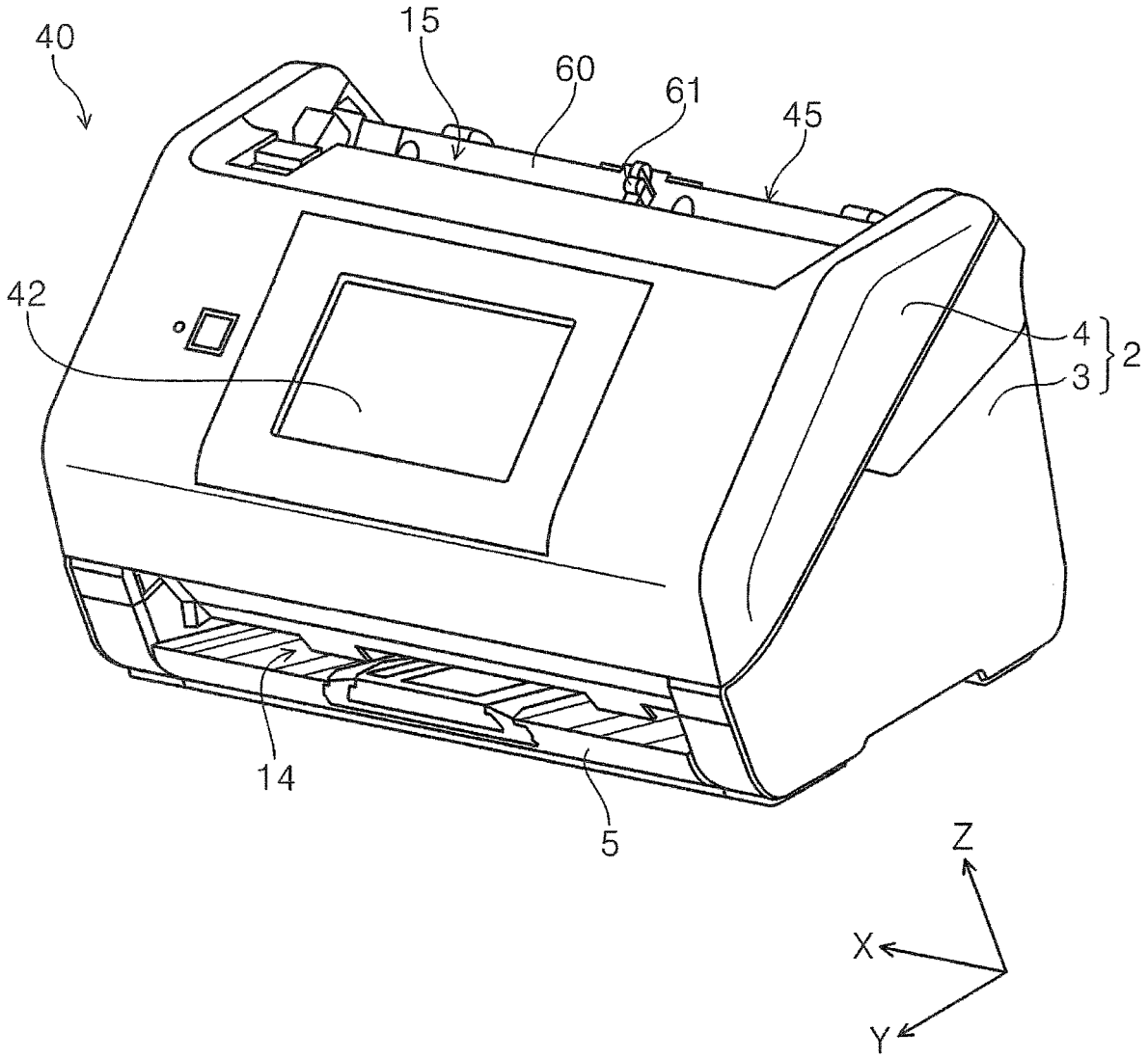
FIG. 15 is a perspective view of the scanner in a state in which an attachment has been attached to a device body, as viewed from the device front face side.
Figure 16:
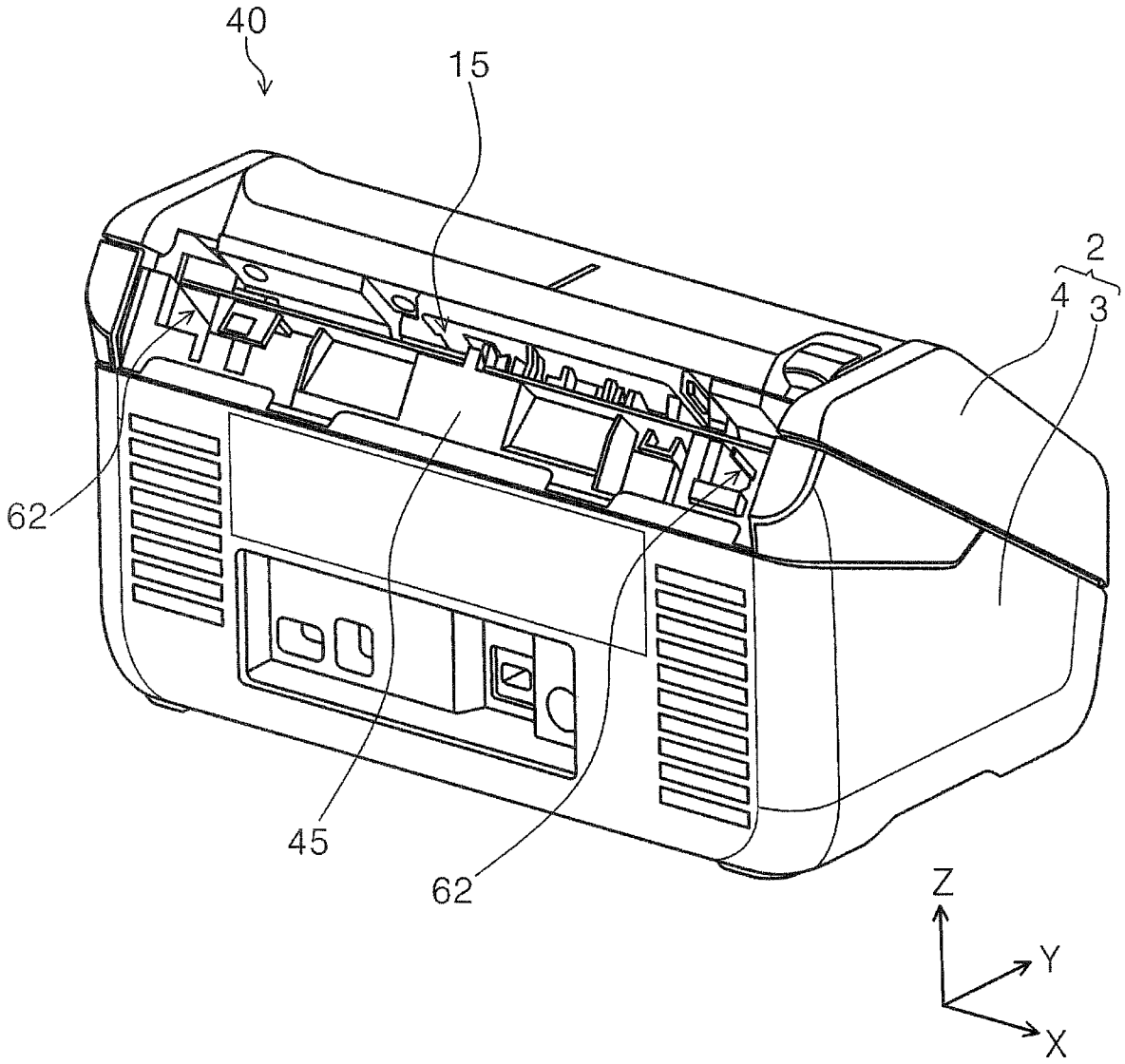
FIG. 16 is a perspective view of the scanner in a state in which an attachment has been attached to a device body, as viewed from the device rear face side.
Figure 17:
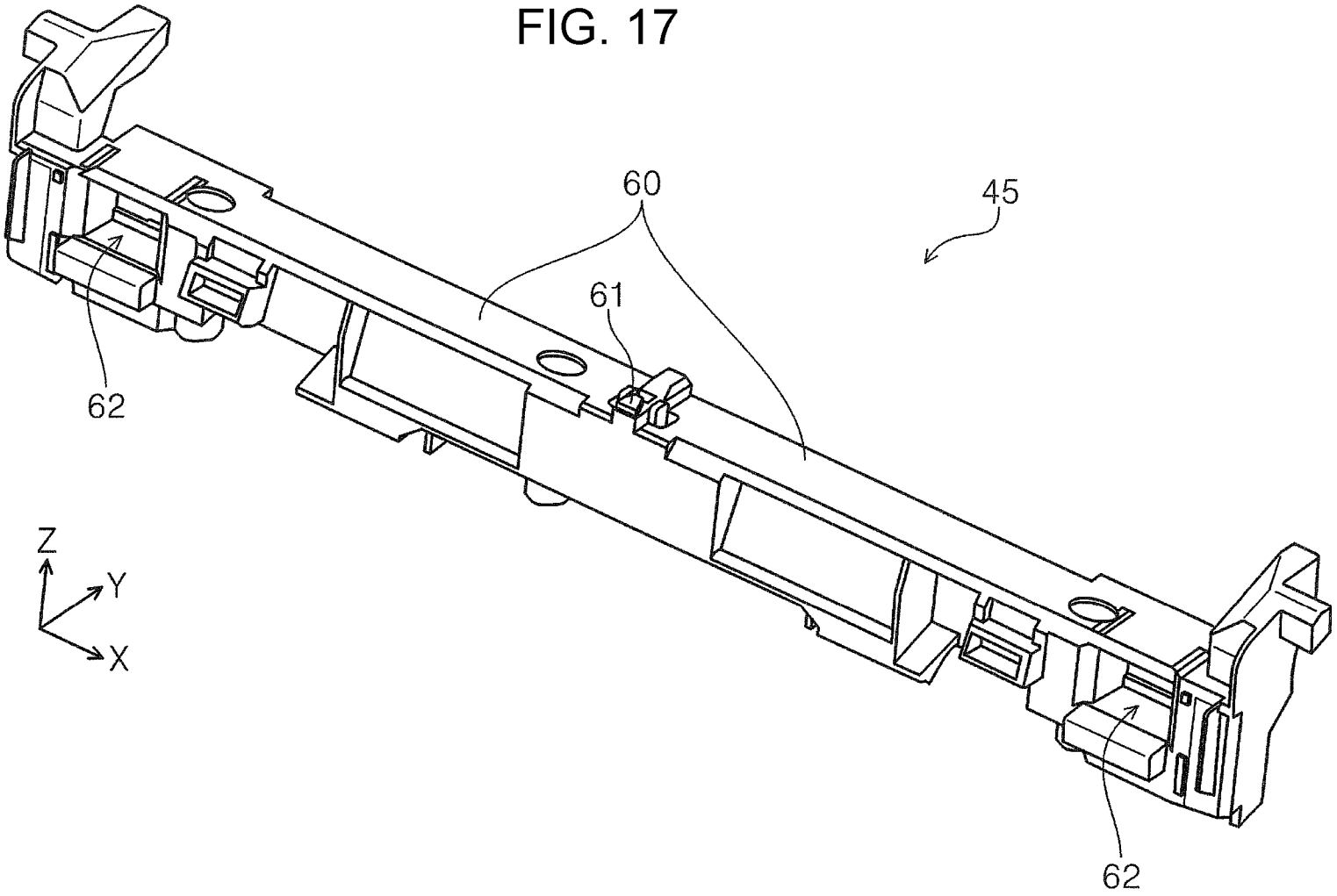
FIG. 17 is an external perspective view of an attachment.
Figure 18:
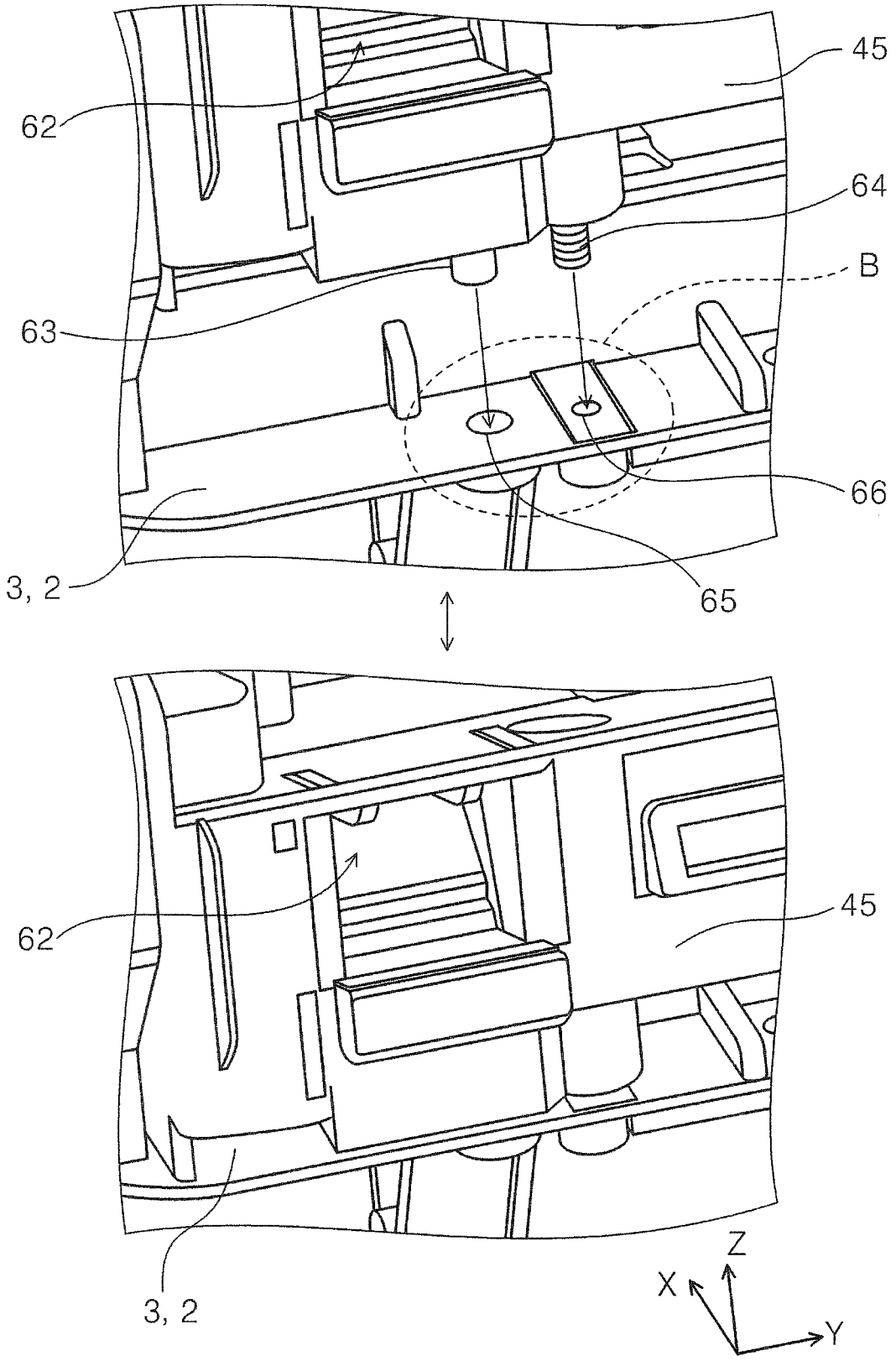
FIG. 18 is a diagram for explaining attaching an attachment to the device body.
Figure 19:
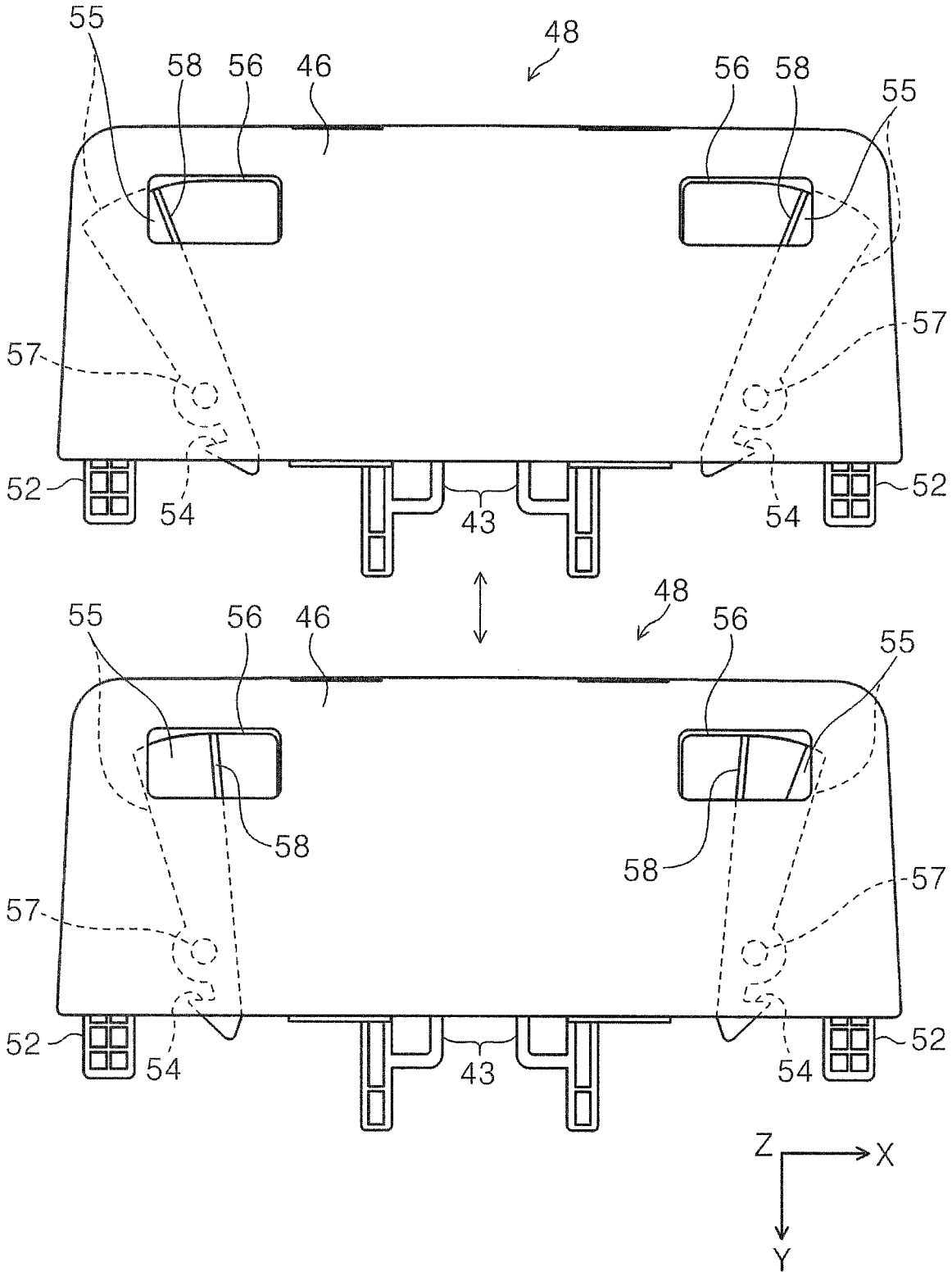
FIG. 19 is an explanatory diagram regarding operation of a lock lever.
Figure 20:
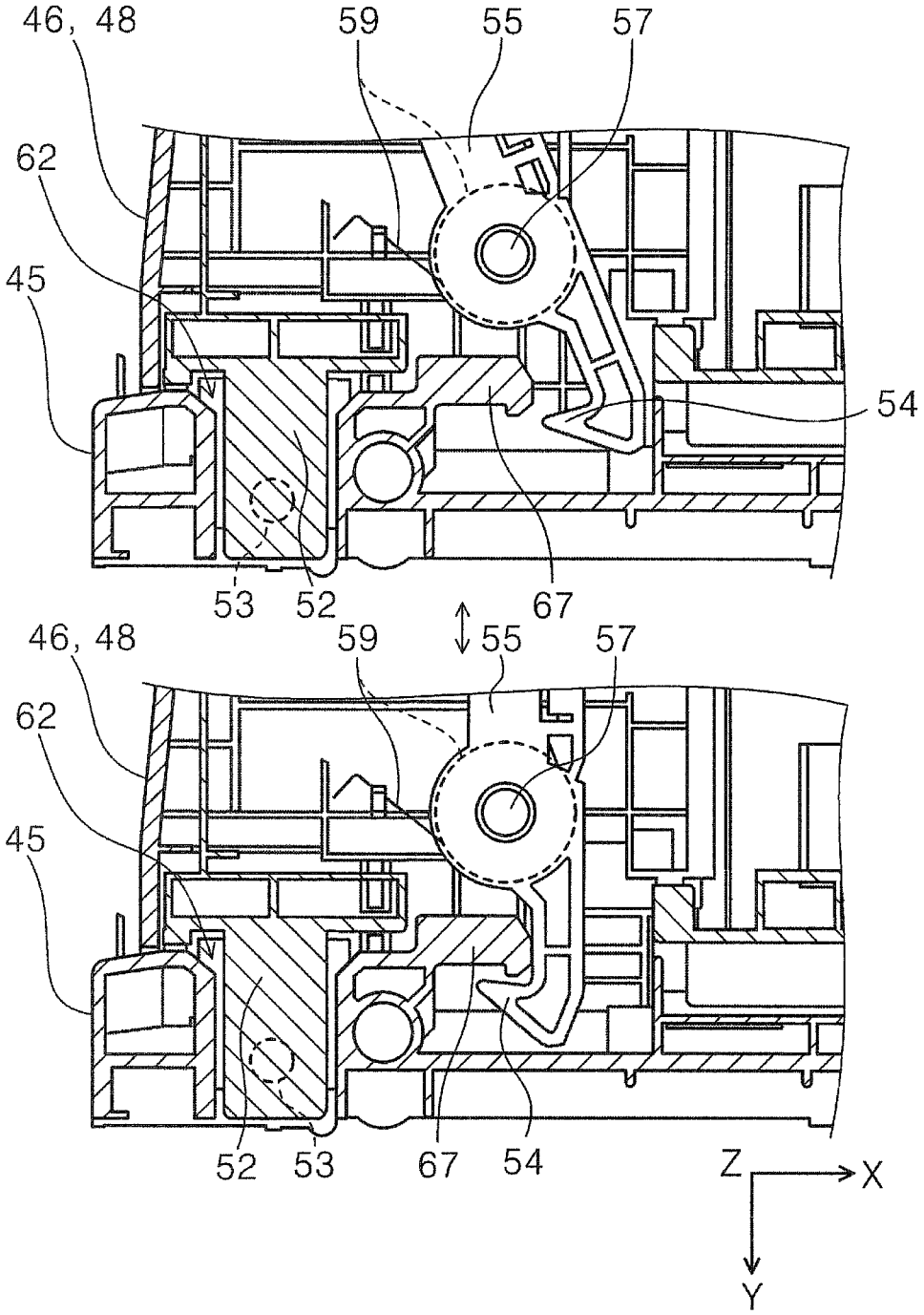
FIG. 20 is a plan-view cross-section of relevant portions of FIG. 19.

FIG. 10 is an external perspective diagram illustrating an attached state of a first unit body in a scanner according to the third embodiment. FIG. 11 is an external perspective diagram illustrating an attached state of a second unit body in the scanner according to the third embodiment. FIG. 12 is a sideways section of the scanner illustrated in FIG. 11. FIG. 13 is a perspective view of the scanner illustrated in FIG. 10 in a state in which the first unit body has been detached from the scanner, as viewed from a device rear face side. FIG. 14 is an external perspective view of the second unit body. FIG. 15 is a perspective view of the scanner in an attached state of an attachment to a device body, as viewed from the device front face side. FIG. 16 is a perspective view of the scanner in a state in which an attachment has been attached to a device body, as viewed from the device rear face side. FIG. 17 is an external perspective view of an attachment. FIG. 18 is an explanatory diagram of attaching an attachment to the device body. FIG. 19 is an explanatory diagram regarding operation of a lock lever. FIG. 20 is a plan-view cross-section of relevant portions of FIG. 19.

A scanner 40 according to the third embodiment has substantially the same external appearance as that of the scanner 1 described in the first embodiment. In the scanner 40, the same reference signs are appended to configuration the same as that of the first embodiment, and description of this configuration is omitted.

An upper unit 4, serving as a device body 2 of the scanner 40, is equipped with an operation panel 42 on the device front face side. Various reading setting/reading execution operations are performed on the operation panel 42, and the operation panel 42 displays read setting content and the like.

The scanner 40 includes a medium feed device 41 to feed the paper P (medium) serving as the source document, with the medium feed device 41 configured with an interchangeable medium support section to support the paper P.

More specifically, the medium support section to support the paper P is interchangeably configured with a first medium support section 44 (FIG. 10) that can be detachably attached to the device body 2, or with a second medium support section 46 (FIG. 11, FIG. 12) that can be attached to the device body 2 through an attachment 45 (FIG. 12) that is detachably provided to the device body 2.

More specifically, the first medium support section 44 illustrated in FIG. 10 is configured as a first unit body 47 equipped with edge guides 12, with the first unit body 47 being installed to the device body 2 in FIG. 10.

The second medium support section 46 illustrated in FIG. 11 is configured as a second unit body 48 (see FIG. 14 as well as FIG. 11) equipped with edge guides 43, 43, and the second unit body 48 is installed to the device body 2 in FIG. 11. Note that the second medium support section 46 is stowable inside the second medium support section 46, and the second medium support section 46 is equipped with auxiliary paper supports 49*a*, 49*b* capable of being pulled out from the second medium support section 46, in a configuration in which the length of a support face 46*a* is adjustable.

In FIG. 10, an auxiliary roller 31 provided at a support face 44*a* of the first medium support section 44 (a back face 7*a* of a first cover section 7) is switchable between a projected state projecting out from the support face 44*a* and a retracted state retracted from the projected state toward the support face 44*a* side. This results in a configuration in which the contact angle α between the paper P supported by the first medium support section 44 and the separator roller 17 can be changed by switching the state of the auxiliary roller 31.

Moreover, an auxiliary roller 51 similar to the auxiliary roller 31 is also provided on the support face 46*a* of the second medium support section 46, see FIG. 11. Namely, the auxiliary roller 51 is configured so as to be switchable between a projected state projecting out from the support face 46*a* and a retracted state retracted to the support face 46*a* side from the projected state. This results in a configuration in which the contact angle α between the paper P supported by the second medium support section 46 and the separator roller 17 can be changed by switching the state of the auxiliary roller 51.

The types of paper feedable by the first medium support section 44 and the types of paper feedable by the second medium support section 46 differ at least in part, and hence more types of paper are feedable by interchanging between the first medium support section 44 (the first unit body 47) and the second medium support section 46 (the second unit body 48).

In the first medium support section 44 and the second medium support section 46, for example, the contact angle α with respect to the separator roller 17 is changed by changing the respective inclination angles of the support face 44*a* and the support face 46*a*, enabling a configuration to be adopted in which the first medium support section 44 and the second medium support section 46 are compatible with different respective types of paper. Moreover, the amounts of projection of the auxiliary roller 31 and the auxiliary roller 51 in their projected states may be changed.

Moreover, similarly to in the first embodiment, the first medium support section 44 doubles as a top cover 6 to open and close the upper section of the device body 2 and is formed with a comparatively thin thickness (see the top cover 6 in FIG. 3), and the second medium support section 46 is fixed to the device body 2 through the attachment 45 (FIG. 12) and is formed thicker in thickness than the first medium support section 44.

The second medium support section 46 is more strongly attached to the device body 2 than the first medium support section 44, enabling more paper P to be placed on the second medium support section 46 than on the first medium support section 44.

Attachment and Second Unit Body Attachment

Description follows regarding attaching of the attachment 45 and the second unit body 48 to the scanner 40, with reference to FIG. 13 to FIG. 20. Attachment of the attachment 45 to the device body 2 will first be described, then attachment of the second unit body 48 to the attachment 45 will be described.

Attachment of Attachment to Device Body

FIG. 13 illustrates the scanner 40 in a state in which the first unit body 47, serving as the first medium support section 44, is detached.

An indentation 65 and a fixing screw hole 66 (for both, see the top of FIG. 18) for determining the fixing position of the attachment 45 (FIG. 17) are provided in an area B positioned at the −X axis direction of the medium setting section 15 in the lower unit 3 (the device body 2) illustrated in FIG. 13. An indentation 65 and a fixing screw hole 66 are also provided at the +X axis direction on the opposite side to the area B in the device width direction. Although the area B side (the −X axis direction side) will be described below, similar applies to the +X axis direction side.

The attachment 45 includes a projection 63 (top of FIG. 18) for positioning below an insertion hole 62 (top of FIG. 17 and FIG. 18), described later, and the attachment position of the attachment 45 to the lower unit 3 is determined by the projection 63 engaging with the indentation 65 on the lower unit 3 side (bottom of FIG. 18).

A fixing screw 64 (top of FIG. 18) is provided in the attachment 45, at the device width direction inside (+X axis direction) of the projection 63. The fixing screw 64 is fastened into the fixing screw hole 66 on the lower unit 3 side (top of FIG. 18), and the attachment 45 is thereby fixed to the lower unit 3 (bottom of FIG. 18). Note that FIG. 15 and FIG. 16 illustrate a state in which the attachment 45 is attached to the lower unit 3.

Attachment of Second Unit Body to Attachment

The attachment 45 includes an insertion hole 62 (FIG. 16 and FIG. 17) at each device width direction (X axis direction) side of the rear face (−Y axis direction) side of the device. Insertion portions 52 (FIG. 14 and FIG. 19) provided at each device width direction (X axis direction) side of the second unit body 48 are inserted into the insertion holes 62 of the attachment 45, and the second unit body 48 is thereby attached to the attachment 45.

In FIG. 14, indentations 53 are provided to the insertion portions 52 so as to engage with non-illustrated protrusions provided on the insertion hole 62 side of the attachment 45. Engagement between the indentations 53 of the insertion portions 52 side and the protrusions (not illustrated in the drawings) on the insertion hole 62 side enable a click-feel to obtained when the second unit body 48 has been attached to the attachment 45, and enable the attachment position of the second unit body 48 to be determined.

Lock levers 55, 55 equipped with engagement portions 54 at their leading ends are provided to the second unit body 48 (FIG. 14, FIG. 19, and FIG. 20), and the engagement portions 54, 54 are engaged with engaged portions 67, 67 (FIG. 20) provided on the attachment 45 side, thereby locking the attachment of the second unit body 48 to the attachment 45.

The lock levers 55, 55 are provided inside the second unit body 48, and as illustrated in FIG. 14, part of each of the lock levers 55, 55, including the respective engagement portion 54, 54, is externally exposed from the second unit body 48.

The lock levers 55 are each provided so as to be capable of swinging about an axis of a swing shaft 57, and the lock levers 55 are each biased to a first state illustrated at the bottom of FIG. 19 and at the bottom of FIG. 20 by respective biasing members 59.

Window portions 56, 56 are provided at the rear face side of the second unit body 48 illustrated in FIG. 19, namely, at the face thereof on the opposite side to the support face 46*a* (FIG. 14). Grip portions 58 are provided at the opposite ends of the lock levers 55, 55 to the engagement portions 54, 54, and the grip portions 58 are exposed through the window portions 56, 56.

The lock levers 55, 55 are swung against biasing force from the biasing members 59 by pressing the grip portions 58 with a hand, finger, or the like, and displacing the grip portions 58 toward the device width direction inside by imparting external force thereon. The lock levers 55, 55 thereby move from the first state to a second state illustrated at the top of FIG. 19 and at the top of FIG. 20.

In the second state as illustrated at the top of FIG. 20, the engagement portions 54, 54 of the lock levers 55, 55 separate from the engaged portions 67, 67 on the attachment 45 side, enabling the second unit body 48 and the attachment 45 to be detached from each other in this state.

By releasing the grip portions 58 after the lock levers 55, 55 have been placed in the second state and the second unit body 48 has been attached to the attachment 45, the lock levers 55, 55 adopt the first state due to biasing force from the biasing members 59, the engagement portions 54, 54 and the engaged portions 67, 67 engage with each other as illustrated at the bottom of FIG. 20, and the attached state of the second unit body 48 to the attachment 45 is locked.

Attachment

Further description follows regarding the configuration of the attachment 45.

The attachment 45 includes a path face 60 that serves as a path for the paper P between the device body 2 and the second medium support section 46. Namely, the attachment 45 is configured to mediate installation of the second medium support section 46 (the second unit body 48) to the device body 2 while also configuring a path for the paper P.

Due to the attachment 45 being equipped with the path face 60, paper can be set in the medium setting section 15 and the scanner 40 used even in a state in which the second unit body 48 has been removed and only the attachment 45 is attached to the device body 2 (FIG. 15).

For example, in cases in which the size of the paper P is small, such as business card size, postcard size, or the like, the paper P can be supported by the path face 60 even in a state in which only the attachment 45 is attached to the device body 2, namely, when in the state illustrated in FIG. 15 in which there is no second medium support section 46 present.

Removing the second medium support section 46 (the second unit body 48) from the device body 2 gives the scanner 40 a more compact appearance, and enables the scanner 40 to be placed with better space-efficiency.

The path face 60 of the attachment 45 is also equipped with at least one rotatable auxiliary roller 61 that contacts at least a portion of the paper P. In the present embodiment, there is a single auxiliary roller 61 provided at a center portion of the path face 60 in the device width direction (X axis direction).

Providing the auxiliary roller 61 on the path face 60 of the attachment 45 enables the paper P to be fed smoothly.

Note that, similarly to the auxiliary roller 31 of the first embodiment, the auxiliary roller 61 may be configured so as to be switchable between a projected state projecting out from the path face 60 and a retracted state retracted from the projected state toward the path face 60 side.

Other Scanner Configuration

An alert unit may be provided to the scanner 40 to prompt a user to change the contact angle α between the paper P and the separator roller based on the type of paper P being fed.

Specifically, a configuration may be adopted in which the alert unit is used to notify a user of cases in which, based on driver information related to the type of paper P set by the user using the operation panel 42, determination is made by a non-illustrated controller provided in the scanner 40 that there is a need to change the contact angle α. The notification may be by display on the operation panel 42, sounding a warning alarm, illuminating a warning lamp, or the like.

The need to change the contact angle α is thereby clearly imparted to the user, thus better ensuring that the user performs an operation to change the contact angle α. This accordingly better ensures appropriate paper P feeding in the medium feed device 41.

Instead of the second medium support section 46 described in the third embodiment, the scanner 40 may employ a second medium support section having another configuration. This thereby enables even more types of paper to be appropriately fed. Namely, the number of types of paper the scanner 40 is compatible with can be increased.

Explanation follows regarding modified examples (Modified Example 1 to Modified Example 3) of the second medium support section which may be employed in the scanner 40. Note that in Modified Example 1 to Modified Example 3, the same reference signs are appended to configuration that is the same as in the third embodiment, and description of such configuration is omitted.

Modified Example 1

Figure 21:
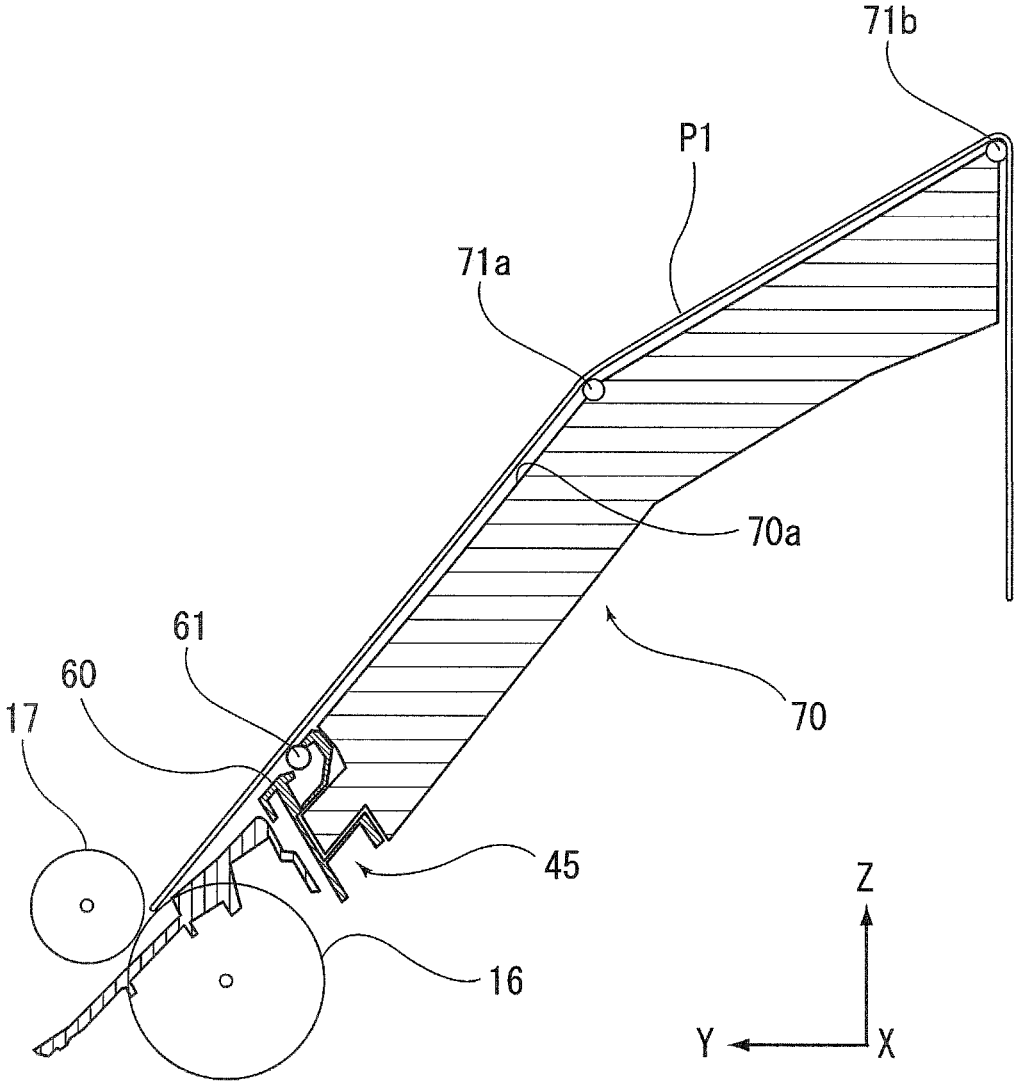
FIG. 21 is a diagram for explaining a second medium support section of Modified Example 1.

Explanation follows regarding a modified example of a second medium support section, with reference to FIG. 21. FIG. 21 is a diagram for explaining a second medium support section of Modified Example 1.

In Modified Example 1, a second medium support section 70 (FIG. 21) is equipped with a rotatable free roller 71*b*. The rotatable free roller 71*b* is provided at an upstream end of the second medium support section 70 in a medium feed direction, contacts at least a portion of paper, and serves as an "auxiliary roller".

Moreover, a free roller 71*a* is provided on a support face 70*a* of the second medium support section 70 at a position separated from the free roller 71*b* along the medium feed direction.

Paper P1 that is long in the medium feed direction may be placed on the second medium support section 70. The trailing end of the paper P1, which has a length that is longer than the support face 70*a* in the medium feed direction, hangs down from the trailing end of the support face 70*a*, as illustrated in FIG. 21.

Providing the free roller 71*b* at the trailing end of the support face 70*a* of the second medium support section 70 reduces concern related to damage due to sliding contact of the paper P1 against the trailing end of the support face 70*a* when the paper P1 hanging down from the support face 70*a* is pulled up as the paper P1 is fed.

The free rollers 71*a*, 71*b* are provided near a center portion of the support face 70*a* in the width direction (X axis direction). Providing the free rollers 71*a*, 71*b* enables the contact resistance between the long paper P1 and the support face 70*a* to be reduced, thereby enabling the long paper P1 to be fed smoothly.

Installing the second medium support section 70 configured in this manner to the device body 2 through the attachment 45 enables a long medium to be appropriately fed in the scanner 40.

Modified Example 2

Figure 22:
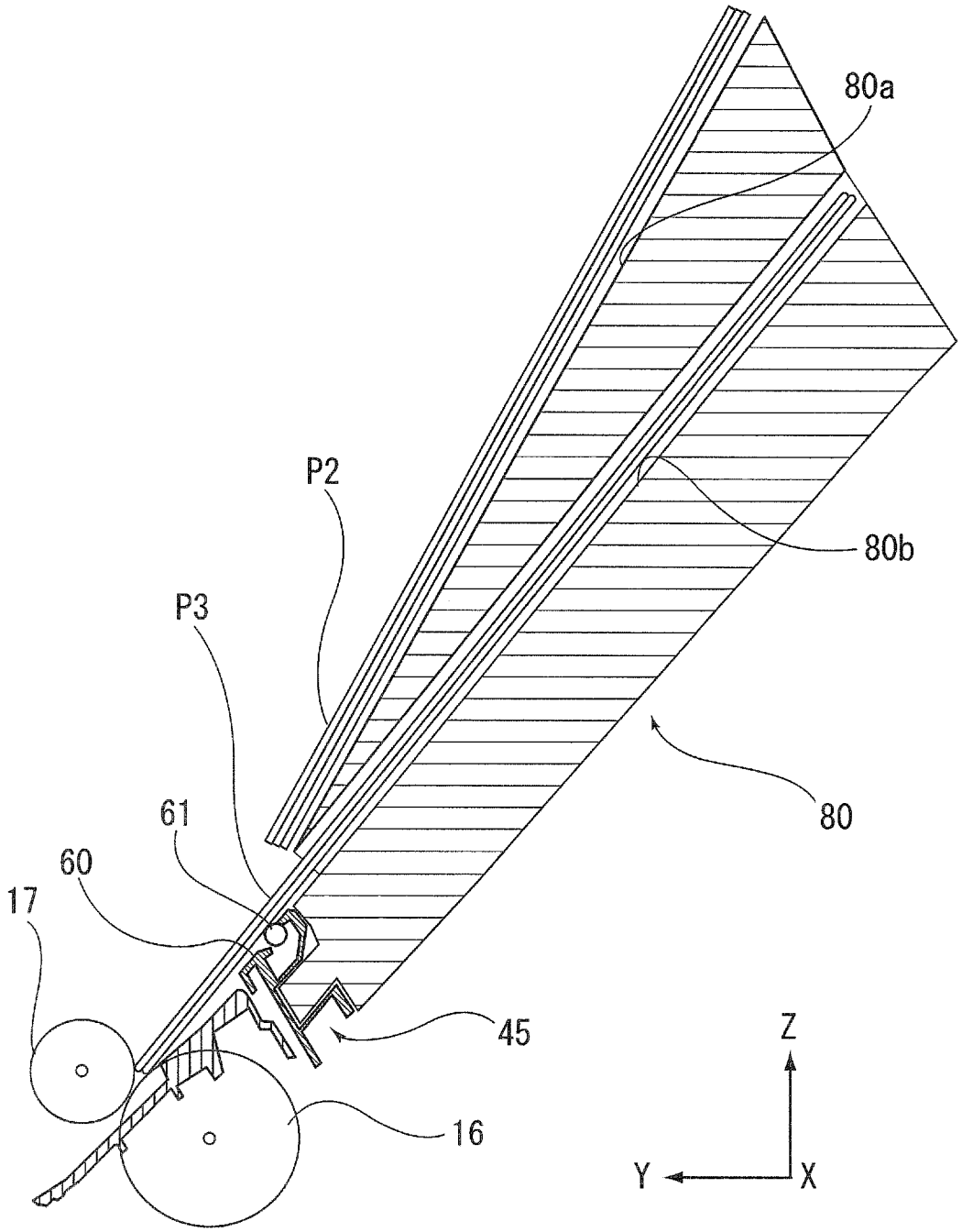
FIG. 22 is a diagram for explaining a second medium support section of a Modified Example 2.

Explanation follows regarding another modified example of the second medium support section, with reference to FIG. 22. FIG. 22 is a diagram for explaining a second medium support section of Modified Example 2.

As illustrated in FIG. 22, in Modified Example 2, a second medium support section 80 includes a first support face 80*a* to support A5 size paper P2 serving as a "first medium", and a second support face 80*b* provided lower than the first support face 80*a* to support A4 size paper P3 serving as a "second medium" having a size different than the paper P2 (the first medium).

Namely, the second medium support section 80 is configured so as to enable both the paper P2 (A5 size) and the paper P3 (A4 size), which are different sizes, to be set on one second medium support section 80. This enables an increase in the types of paper that can be read by the scanner 40.

Moreover, the first support face 80*a* forms a steeper face than the second support face 80*b*, and the first support face 80*a* and the second support face 80*b* are formed so as to converge upstream of the path face 60 of the attachment 45.

Thus a contact angle α (see FIG. 4) between paper and the separator roller 17 can be changed when paper is set on the first support face 80*a* and when paper is set on the second support face 80*b*. This enables the breadth of the types of appropriately feedable paper to be expanded.

Modified Example 3

Figure 23:
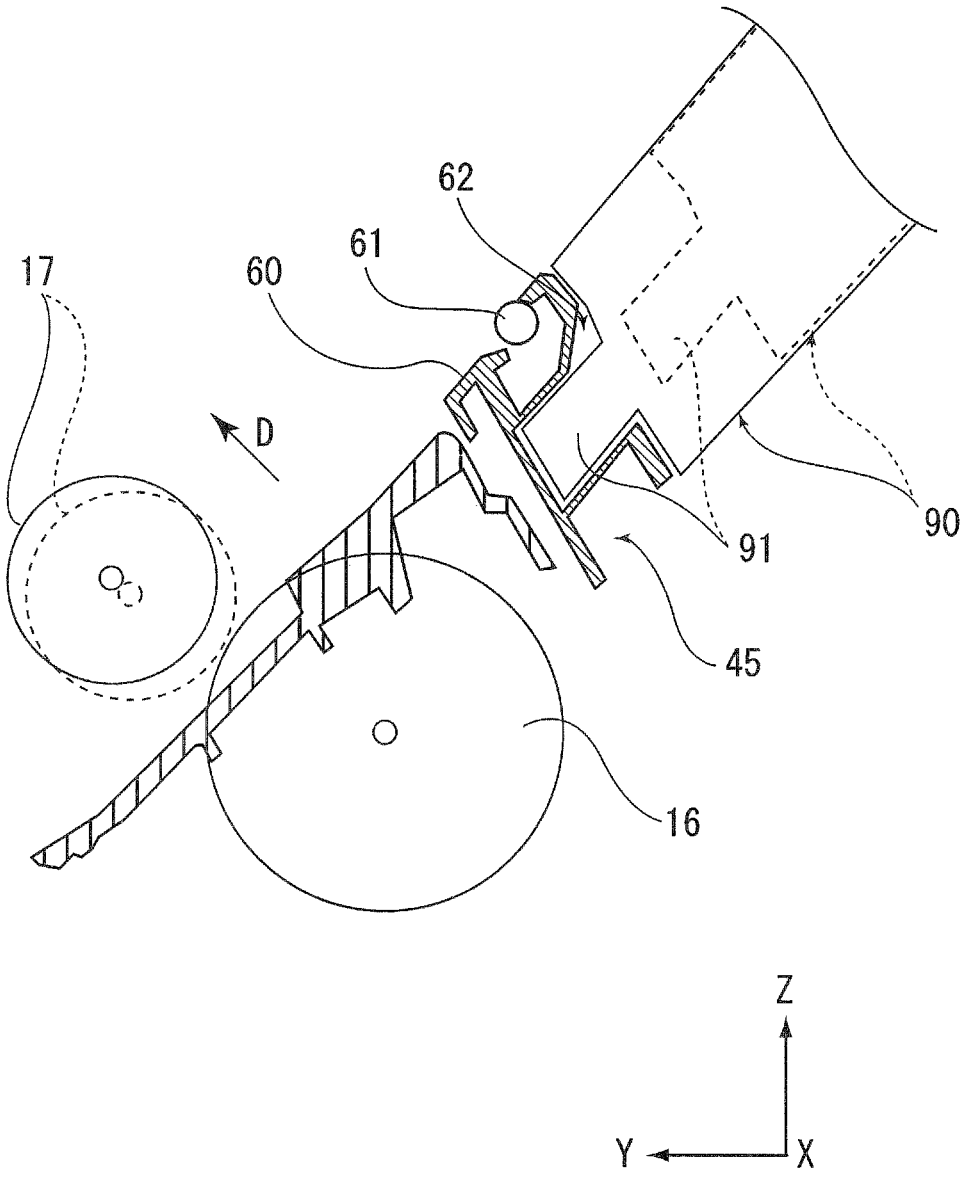
FIG. 23 is a diagram for explaining a second medium support section of a Modified Example 3.

Yet another modified example of the second medium support section will now be described, with reference to FIG. 23. FIG. 23 is a diagram for explaining a second medium support section of Modified Example 3.

A second medium support section 90 includes an insertion portion 91 that can be inserted into an insertion hole 62 provided to the attachment 45. The second medium support section 90 is configured so as to be detachably attached to the attachment 45 installed to the device body 2.

Configuration is such that the separator roller 17 is separated from the feed roller 16 when the insertion portion 91 of the second medium support section 90 is inserted into the insertion hole 62 of the attachment 45 and the second medium support section 90 has been installed to the attachment 45.

In a state in which the second medium support section 90 is not attached to the attachment 45, the separator roller 17 approaches the feed roller 16 as indicated by the broken line in FIG. 23, the separator roller 17 separates the lowermost sheet out of plural sheets of the paper P, and the feed roller 16 feeds the lowermost sheet of the paper P downstream.

When the second medium support section 90 is attached to the attachment 45, the separator roller 17 displaces in the direction indicated by arrow D in FIG. 23, and separates from the feed roller 16. This enables a configuration to be achieved in which separation is not performed by the separator roller 17 when the second medium support section 90 has been installed to the attachment 45.

For example, in cases in which the paper P is a medium of high stiffness, such as card stock or the like, the paper readily separates without the separator roller 17, and there is a tendency for the paper P to mis-feed due to its separation resistance if the separator roller 17 is present.

In such cases, concern related to the mis-feeding of paper P of high stiffness can be reduced by employing the second medium support section 90.

A mechanism to separate the separator roller 17 from the feed roller 16 by installing the second medium support section 90 to the attachment 45 may, for example, be achieved by employing a cam mechanism operated upon being triggered by the insertion of the insertion portion 91 into the insertion hole 62, or the like. Moreover, another possible configuration is one in which insertion of the insertion portion 91 into the insertion hole 62 sends an electrical signal to a non-illustrated controller, and the controller controls a drive section to displace the separator roller 17.

Note that there is no limitation to the embodiments described above, and various modifications are possible within the scope of the invention as recited in the claims, and it goes without saying that such embodiments fall within the scope of the invention.

The entire disclosure of Japanese Patent Application No. 2017-000918, filed Jan. 6, 2017 is expressly incorporated by reference herein.

What is claimed is:

1. A medium feed device comprising:

a feed roller that is provided to a device body and that feeds a medium;

a separator roller that is provided at a position on the device body facing the feed unit and that separates the medium, wherein the feed roller and the separator roller are adjacent to each other such that medium is nipped between the feed roller and the separator roller when being separated by the separator roller; and a medium support section that supports the medium in an inclined state upstream of the feed unit, wherein the medium support section is configured with a variable contact angle between the medium supported by the medium support section and the separator unit, and includes at least one rotatable auxiliary roller that contacts at least part of the medium and that is provided on a face supporting the medium, wherein the device body is configured including a lower unit and an upper unit, the upper unit is attached to the lower unit so as to be capable of swinging with a paper transport direction downstream side of the lower unit acting as a swing point, and wherein the medium support section is configured to switch an inclination angle of the medium support section providing an engagement protrusion on a swing shaft of the medium support section, providing plural engagement indentations on the lower unit, and switching the engagement indentation the engagement protrusion of the swing shaft engages with.

2. The medium feed device according to claim 1, wherein the feed roller contacts a lowermost medium from out of a plurality of medium supported by the medium support section and rotates to feed the lowermost medium.

3. The medium feed device according to claim 1, wherein the medium support section is configured with a variable inclination angle.

4. The medium feed device according to claim 3, wherein the medium support section is provided to be capable of swinging with respect to the device body.

5. The medium feed device according to claim 4, wherein the auxiliary roller is configured to be switchable between a projected state projecting out from support face and a retracted state retracted from the projected state toward the support face side.

6. The medium feed device according to claim 1, wherein the medium support section is configured to move by rotation of a pivot member attached to an end of the medium support section between a first variable contact angle and a second variable contact angle that is smaller than the first variable contact angle based on a stiffness property of the medium being separated by the separator unit such that when the stiffness property of the medium is relatively high, the medium support section is set to the first variable contact angle by movement of the pivot member and when the stiffness property of the medium is relatively low, the medium support section is set to the second variable contact angle by movement of the pivot member.

* * * * *